US010253477B2

(12) United States Patent
Kato

(10) Patent No.: US 10,253,477 B2
(45) Date of Patent: Apr. 9, 2019

(54) WORK VEHICLE

(71) Applicant: KOMATSU LTD., Tokyo (JP)

(72) Inventor: Yasunari Kato, Komatsu (JP)

(73) Assignee: KOMATSU LTD., Tokyo (JP)

( * ) Notice: Subject to any disclaimer, the term of this patent is extended or adjusted under 35 U.S.C. 154(b) by 23 days.

(21) Appl. No.: 15/516,758

(22) PCT Filed: Oct. 21, 2016

(86) PCT No.: PCT/JP2016/081343
§ 371 (c)(1),
(2) Date: Apr. 4, 2017

(87) PCT Pub. No.: WO2017/051933
PCT Pub. Date: Mar. 30, 2017

(65) Prior Publication Data

US 2018/0112374 A1 Apr. 26, 2018

(51) Int. Cl.
*E02F 3/28* (2006.01)
*E02F 9/08* (2006.01)
(Continued)

(52) U.S. Cl.
CPC ..... *E02F 9/16* (2013.01); *E02F 9/0841* (2013.01); *E02F 9/2004* (2013.01); *E02F 9/225* (2013.01); *E02F 3/283* (2013.01)

(58) Field of Classification Search
CPC ..... E02F 9/16; E02F 9/0841; E02F 9/2004; E02F 9/225; E02F 3/283
See application file for complete search history.

(56) References Cited

U.S. PATENT DOCUMENTS 6,352,133 B1 * 3/2002 Ojima ..... E02F 9/16 180/326
6,450,278 B1 * 9/2002 Shirogami ..... E02F 9/2004 180/315
(Continued)

FOREIGN PATENT DOCUMENTS

CN 101289157 A 10/2008
JP 7-280167 A 10/1995
(Continued)

OTHER PUBLICATIONS

The International Search Report for the corresponding international application No. PCT/JP2016/081343, dated Nov. 15, 2016.
(Continued)

*Primary Examiner* — Drew J Brown
(74) *Attorney, Agent, or Firm* — Global IP Counselors, LLP

(57) ABSTRACT

The wheel loader includes a console box and a bellows. The console box is disposed on the side of an operator's seat, and is rotatable in the forward and backward direction between an operation position in which the console box is disposed horizontally and a retracted position in which the console box is rotated rearward from the operation position. The bellows has a lower end and an upper end. The lower end is fixed on the floor side of the operator's seat. The upper end is rotatably linked to the console box in the forward and backward direction around a rotary shaft running in the left and right direction.

9 Claims, 19 Drawing Sheets

(51) Int. Cl.

| | |
|---|---|
| ***E02F 9/16*** | (2006.01) |
| ***E02F 9/20*** | (2006.01) |
| ***E02F 9/22*** | (2006.01) |

(56) References Cited

U.S. PATENT DOCUMENTS

| | | | | |
|---|---|---|---|---|
| 7,036,250 | B2 * | 5/2006 | Dressler | E02F 9/2004 180/326 |
| 7,395,894 | B2 * | 7/2008 | Jang | E02F 9/2004 180/271 |
| 2008/0252127 | A1 | 10/2008 | Kim | |
| 2012/0104798 | A1 * | 5/2012 | Takeda | E02F 9/16 296/190.08 |
| 2015/0115659 | A1 * | 4/2015 | Kurushima | E02F 3/325 296/190.08 |
| 2015/0360593 | A1 | 12/2015 | Mahler et al. | |
| 2018/0002895 | A1 * | 1/2018 | Misaki | E02F 9/20 |
| 2018/0058037 | A1 * | 3/2018 | Muramoto | B60R 7/04 |
| 2018/0112372 | A1 * | 4/2018 | Kato | E02F 3/3668 |

FOREIGN PATENT DOCUMENTS

| | | | |
|---|---|---|---|
| JP | 2002-21120 | A | 1/2002 |
| JP | 2004-118326 | A | 4/2004 |
| JP | 2007-100788 | A | 4/2007 |
| JP | 2010-90589 | A | 4/2010 |
| JP | 4550605 | B2 | 9/2010 |

OTHER PUBLICATIONS

The Office Action for the corresponding Japanese application No. 2017-507021, dated Dec. 8, 2017.

The extended European search report for the corresponding European application No. 16848721.3 dated Mar. 23, 2018.

The Office Action for the corresponding Chinese application No. 201680003097.9, dated Nov. 23, 2018.

* cited by examiner

WORK VEHICLE

CROSS-REFERENCE TO RELATED APPLICATIONS

This application is a U.S. National stage application of International Application No. PCT/JP2016/081343, filed on Oct. 21, 2016.

BACKGROUND

Field of the Invention

The present invention relates to a work vehicle

Description of the Related Art

A configuration of a wheel loader, a hydraulic excavator, or another such work vehicle has been disclosed in which a console box is disposed on the side of an operator's seat, and a joystick is provided to the console box (see Japanese Patent No. 4,550,605, for example).

With the work vehicle in Japanese Patent No. 4,550,605, the operator uses the joystick to change the open or closed state of the port of a pilot valve and to change the pilot pressure. The flow of fluid from the steering valve to the hydraulic actuator is adjusted according to the changed pilot pressure, which changes the steering angle of the work vehicle.

Since the pilot valve is disposed on the lower side of the floor of the operator's seat, a link or the like is provided from under the console box toward the lower side of the floor in order to transmit the operation of the joystick to the pilot valve. A bellows is disposed so as to cover the outside of this link, and the configuration is such that neither the operator nor anyone else will come into direct contact with the link.

SUMMARY

However, since the bellows expands, contracts, and distorts as the console box rotates, it is prone to deterioration.

The present invention is conceived in light of the above problem encountered in the past, and it is an object thereof to provide a work vehicle with which deterioration of the bellows can be suppressed.

In order to achieve the stated object, the work vehicle pertaining to a first exemplary embodiment of the present invention comprises a console box and a bellows. The console box is disposed on the side of an operator's seat, and is able to rotate in the forward and backward direction around a first rotary shaft running in the left and right direction between an operation position in which the console box is disposed horizontally and a retracted position in which the console box is rotated rearward from the operation position. The bellows has a lower end and an upper end. The lower end is fixed on the floor side of the operator's seat. The upper end is linked to the console box rotatably in the forward and backward direction around a second rotary shaft running in the left and right direction.

Since the upper end of the bellows is thus rotatably linked to the console box, in the rotation of the console box, the upper end of the bellows need not rotate the same angle as the console box.

Consequently, there is less distortion during rotation of the console box, so there is less deterioration of the bellows.

The work vehicle pertaining to a second exemplary embodiment of the present invention is the work vehicle pertaining to the first exemplary embodiment of the present invention, wherein the console box has a pair of linking components. A pair of first through-holes that are opposite each other in the left and right direction are formed in the linking components. A pair of second through-holes that are opposite each other in the left and right direction are formed in the upper end of the bellows. A pin is inserted into the first through-hole and second through-hole in each of the left and right linking components.

Consequently, in the rotation of the console box, the upper end of the bellows rotates around the pins and relatively with respect to the console box, so distortion of the bellows can be suppressed.

The work vehicle pertaining to a third exemplary embodiment of the present invention is the work vehicle pertaining to the second exemplar embodiment of the present invention, wherein the first through-holes and/or the second through-holes are slots. The pins are inserted slidably in the slots.

Consequently, the upper end of the bellows is such that the pins can slide through the through-holes, which reduces the rotation and the expansion and contraction of the bellows.

The work vehicle pertaining to a fourth exemplary embodiment of the present invention is the work vehicle pertaining to the third exemplary embodiment of the present invention, wherein the slots are formed in a linear shape, facing upward and obliquely rearward from below.

Consequently, the pins can slide more smoothly through the slots as the console box rotates rearward.

The work vehicle pertaining to a fifth exemplary embodiment of the present invention is the work vehicle pertaining to the first exemplary embodiment of the present invention, further comprising a support component. The support component has the first rotary shaft and rotatably supports the console box. The console box is configured to be capable of sliding in the forward and backward direction with respect to the support component.

Even though the console box is configured to be capable of sliding and rotating, the rotation and the expansion and contraction of the bellows can be suppressed.

The work vehicle pertaining to a sixth exemplary embodiment of the present invention is the work vehicle pertaining to the first exemplary embodiment of the present invention, further comprising an operation lever, a hydraulic actuator, a control valve, and a linking component. The operation lever is provided to the console box. The hydraulic actuator changes the steering angle according to the supplied fluid. The control valve is disposed on the lower side of the floor of the operator's seat and controls the fluid supplied to the hydraulic actuator. The linking component links the operation lever and the control valve. The bellows covers the area around the linking component.

Consequently, since distortion of the bellows is suppressed, interference of the bellows with the linking component can also be reduced, and deterioration of the bellows can be suppressed.

The present invention provides a work vehicle with which deterioration of the bellows can be suppressed.

BRIEF DESCRIPTION OF DRAWINGS

FIG. 5A shows the cross sectional configuration of FIG. 4.

DETAILED DESCRIPTION OF EXEMPLARY EMBODIMENTS

The wheel loader in an exemplary embodiment pertaining to the present invention will now be described through reference to the drawings.

1. Overview of Wheel Loader Configuration

Figure 1:
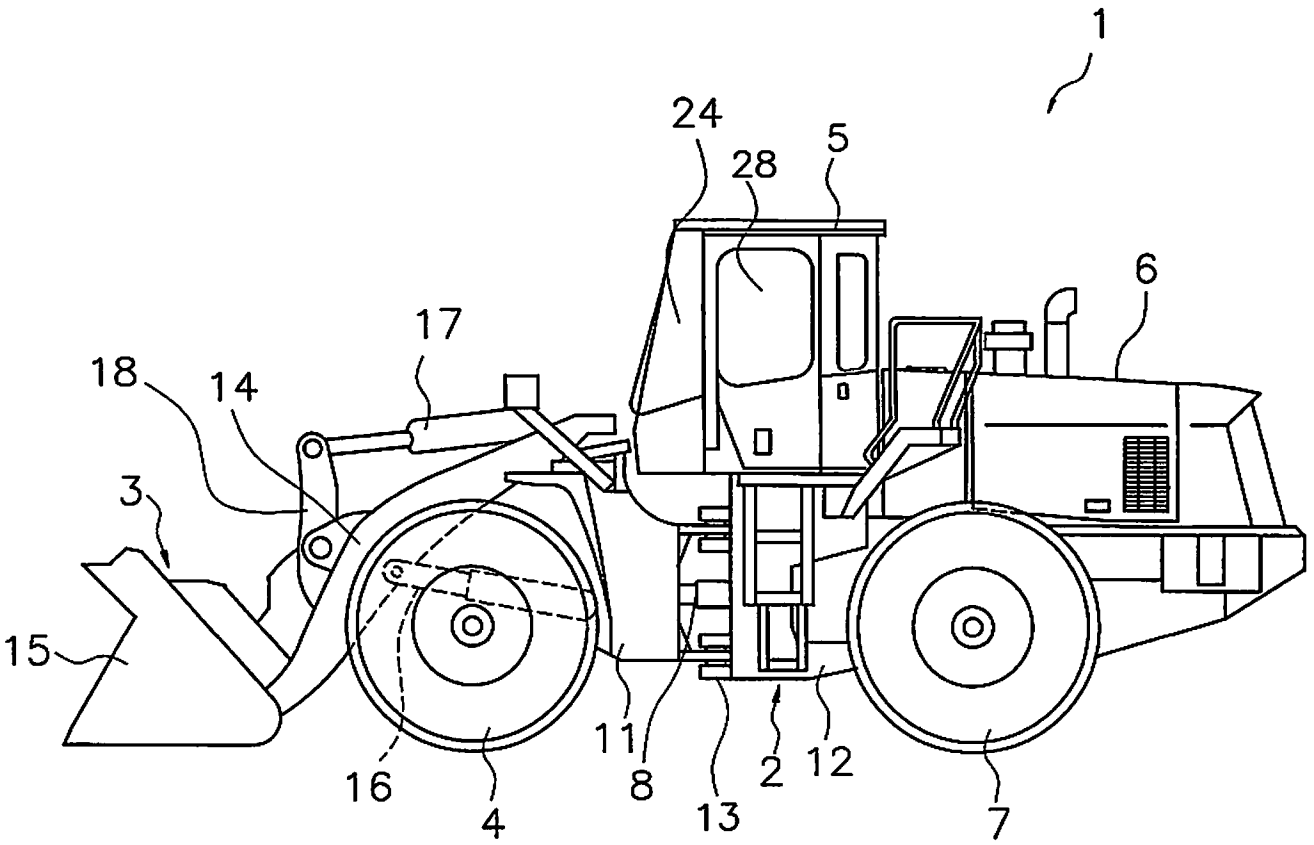
FIG. 1 is a side view of a wheel loader in an exemplary embodiment pertaining to the present invention.

FIG. 1 is a simplified view of the configuration of a wheel loader 1 in this exemplary embodiment. The wheel loader 1 in this exemplary embodiment mainly comprises a body frame 2, a work implement 3, a pair of front tires 4, a cab 5, an engine compartment 6, a pair of rear tires 7, and a pair of steering cylinders 8.

In this exemplary embodiment, the forward, rearward, left, and right directions refer to those directions as seen by an operator sitting in an operator's seat 30 (FIG. 2, discussed below) inside the cab 5.

The wheel loader 1 uses the work implement 3 to perform work, such as scooping up soil.

The body frame 2 is an articulated type, and has a front frame 11, a rear frame 12, and a linking shaft 13. The front frame 11 is disposed ahead of the rear frame 12. The linking shaft 13 is provided in the middle in the vehicle width direction, and links the front frame 11 and the rear frame 12 so that the front frame 11 and the rear frame 12 can pivot with respect to each other. The front tires 4 are attached on the left and right sides of the front frame 11. The rear tires 7 are attached on the left and right sides of the rear frame 12.

The work implement 3 is driven by hydraulic fluid from a work implement pump (not shown). The work implement 3 has a boom 14, a bucket 15, a lift cylinder 16, and a bucket cylinder 17. The boom 14 is mounted to the front frame 11. The bucket 15 is attached to the distal end of the boom 14.

The lift cylinder 16 and the bucket cylinder 17 are hydraulic cylinders. One end of the lift cylinder 16 is attached to the front frame 11, and the other end of the lift cylinder 16 is attached to the boom 14. The extension and retraction of the lift cylinder 16 causes the boom 14 to pivot up and down. One end of the bucket cylinder 17 is attached to the front frame 11, and the other end of the bucket cylinder 17 is attached to the bucket 15 via a bell crank 18. The extension and retraction of the bucket cylinder 17 causes the bucket 15 to pivot up and down.

The steering cylinders 8 are disposed on the left and right sides in the vehicle width direction of the linking shaft 13, and are each attached to the front frame 11 and the rear frame 12. The amount of fluid supplied to the steering cylinders 8 is varied to change the steering angle of the front frame 11 with respect to the rear frame 12, and thereby change the travel direction of the wheel loader 1.

The cab 5 rests on top of the rear frame 12, and in its interior are disposed a steering wheel 37 or joystick 32 (see FIG. 2; discussed below) used for steering operation, levers for controlling the work implement 3, various kinds of display device, and so forth. The engine compartment 6 is disposed on the rear frame 12 and to the rear of the cab 5, and houses an engine.

2. Cab Configuration

Figure 2:
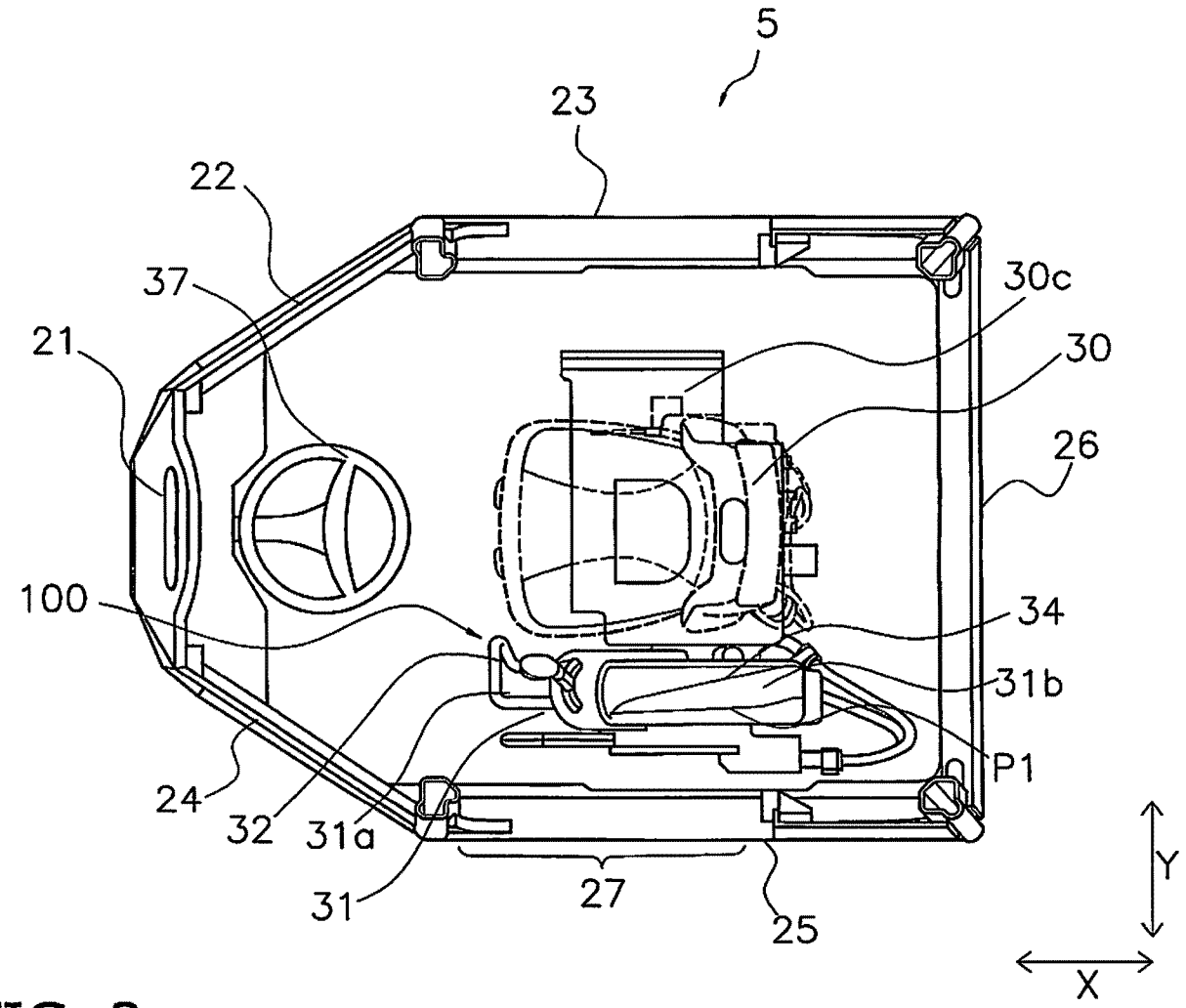
FIG. 2 is a top view of the configuration inside the cab in FIG. 1 in a state in which the console box is disposed in the operation position.
Figure 3:
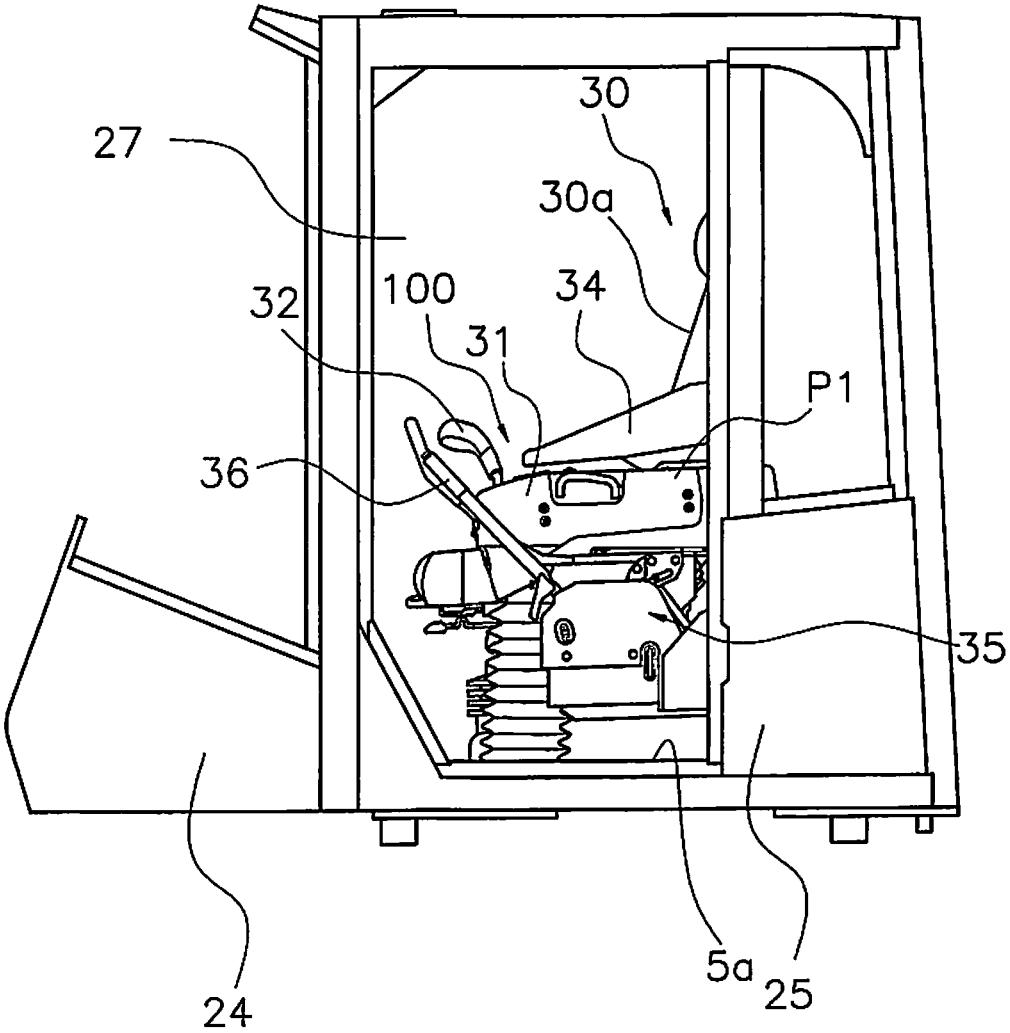
FIG. 3 is a left side view of the configuration of the cab in FIG. 1 in a state in which the console box is disposed in the operation position.

FIG. 2 is a top view of the cab 5. FIG. 3 is a partial side view of the cab 5. As shown in FIG. 2, in top view the cab 5 is substantially hexagonal, and has a front face 21, a right angled face 22, a right side face 23, a left angled face 24, a left side face 25, and a rear face 26. The front face 21 and the rear face 26 are parallel to each other, and are each disposed in the left and right direction (see the arrow Y in FIG. 2). The right side face 23 is disposed facing forward from the right end of the rear face 26. The right angled face 22 is disposed at an angle to the forward and backward direction (see the arrow X in FIG. 2), and is provided between the front end of the right side face 23 and the right end of the front face 21. The left side face 25 is disposed facing forward from the left end of the rear face 26. The left angled face 24 is at an angle to the forward and backward direction, and is provided between the front end of the left side face 25 and the left end of the front face 21. The right angled face 22 and the left angled face 24 are disposed such that the distance between them narrows moving forward. The right angled face 22 and the left angled face 24 are disposed at an angle to the forward and backward direction in order to avoid interference with the front frame during steering operations.

A door opening 27 is located at a position ahead of the left side face 25, and the door 28 shown in FIG. 1 is provided to this door opening 27.

3. Internal Configuration of Cab

Figure 4:
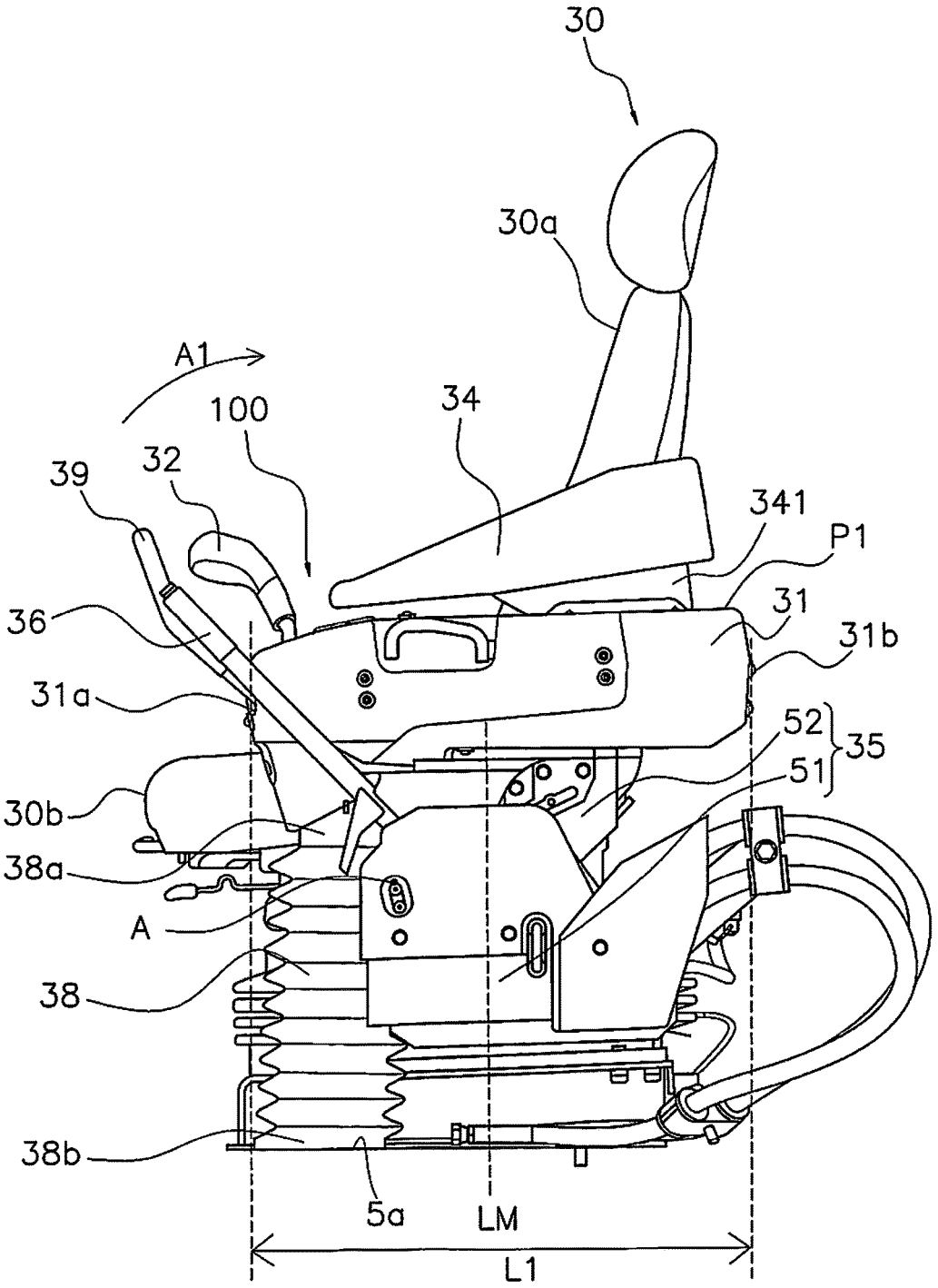
FIG. 4 is a side view of the operator's seat in FIG. 3 and of the console box assembly in a state in which the console box is disposed in the operation position.

FIG. 4 shows the state when the left side face 25 has been removed in FIG. 3.

The operator's seat 30, a console box assembly 100, the steering wheel 37 (see FIG. 2), and so forth are provided inside the cab 5. The console box assembly 100 is disposed on the left side of the operator's seat 30, has the joystick 32 and so forth, and is used by the operator to perform steering operations.

4. Operator's Seat, Steering Wheel

As shown in FIG. 2, the operator's seat 30 is disposed in the approximate center between the right side face 23 and the left side face 25. The operator's seat 30 is disposed at a position that is more or less opposite the door opening 27. As shown in FIG. 4, the operator's seat 30 has a backrest 30*a*, a seat bottom 30*b*, a lower frame 30*c* (see FIG. 7; discussed below) that is under the seat bottom 30*b*, and so on, and a spring (not shown) is disposed under the lower frame 30*c*.

The steering wheel 37 is used by the operator to change the steering angle of the front frame 11 with respect to the rear frame 12 during movement, etc. As shown in FIG. 2, the steering wheel 37 is disposed ahead of the operator's seat 30 and is disposed between the right angled face 22 and the left angled face 24.

5. Console Box Assembly

The console box assembly 100 has a joystick 32 that is used by the operator during steering operations, a console box 31 that supports the joystick 32, and so forth.

The console box assembly 100 has a console box 31 (see FIG. 4), a joystick 32 (see FIG. 4), a link 33 (see FIG. 5; discussed below), an armrest 34 (see FIG. 4), a support component 35 (see FIG. 4), a rotary lever 36 (see FIG. 4), a bellows 38 (see FIG. 4), and so forth.

5-1. Console Box

The console box 31 is disposed on the left side of the operator's seat 30. The console box 31 could also be said to be disposed between the operator's seat 30 and the door opening 27. As shown in FIG. 4, the console box 31 is disposed substantially horizontally, and is formed longer in the forward and backward direction. Parts of the joystick 32 and the link 33, etc. (discussed below), are provided inside the console box 31. As shown in FIG. 4, the position of the console box 31, which is disposed substantially horizontally, is the operation position P1. The operation position P1 is the position of the console box 31 when the operator sits in the operator's seat 30 and operates the joystick 32.

The internal configuration of the console box 31 will be discussed in detail below, but the console box 31 is able to slide in the forward and backward direction, and in FIG. 4 is disposed at the rear end.

5-2. Joystick

As shown in FIG. 4, the joystick 32 is provided so as to protrude upward on the upper side near the front end 31*a* of the console box 31.

The joystick 32 is used to scoop up and transport soil and in other such jobs. The steering angle of the front frame 11 with respect to the rear frame 12 is changed by rotating the joystick 32 in the left and right direction. A guard member 39 that guards the joystick 32 is provided to the front end 31*a* of the console box 31.

5-3. Link

FIG. 5A is a cross section of the console box assembly 100, and shows the interior of the bellows 38. FIG. 6 is an oblique view of FIG. 5A.

Figure 5B:
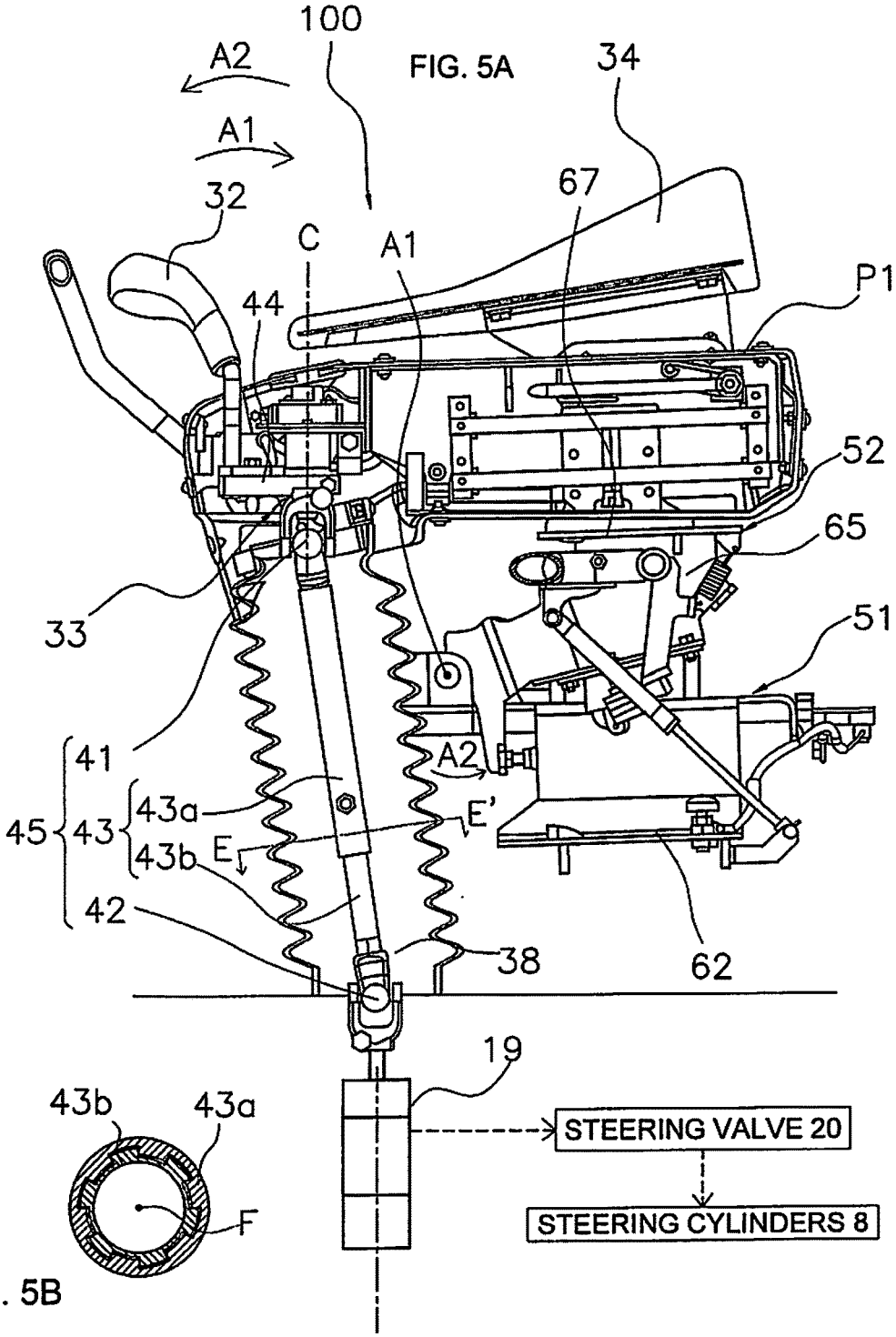
FIG. 5B is a cross section along the E-E' line in FIG. 5A.
Figure 6:
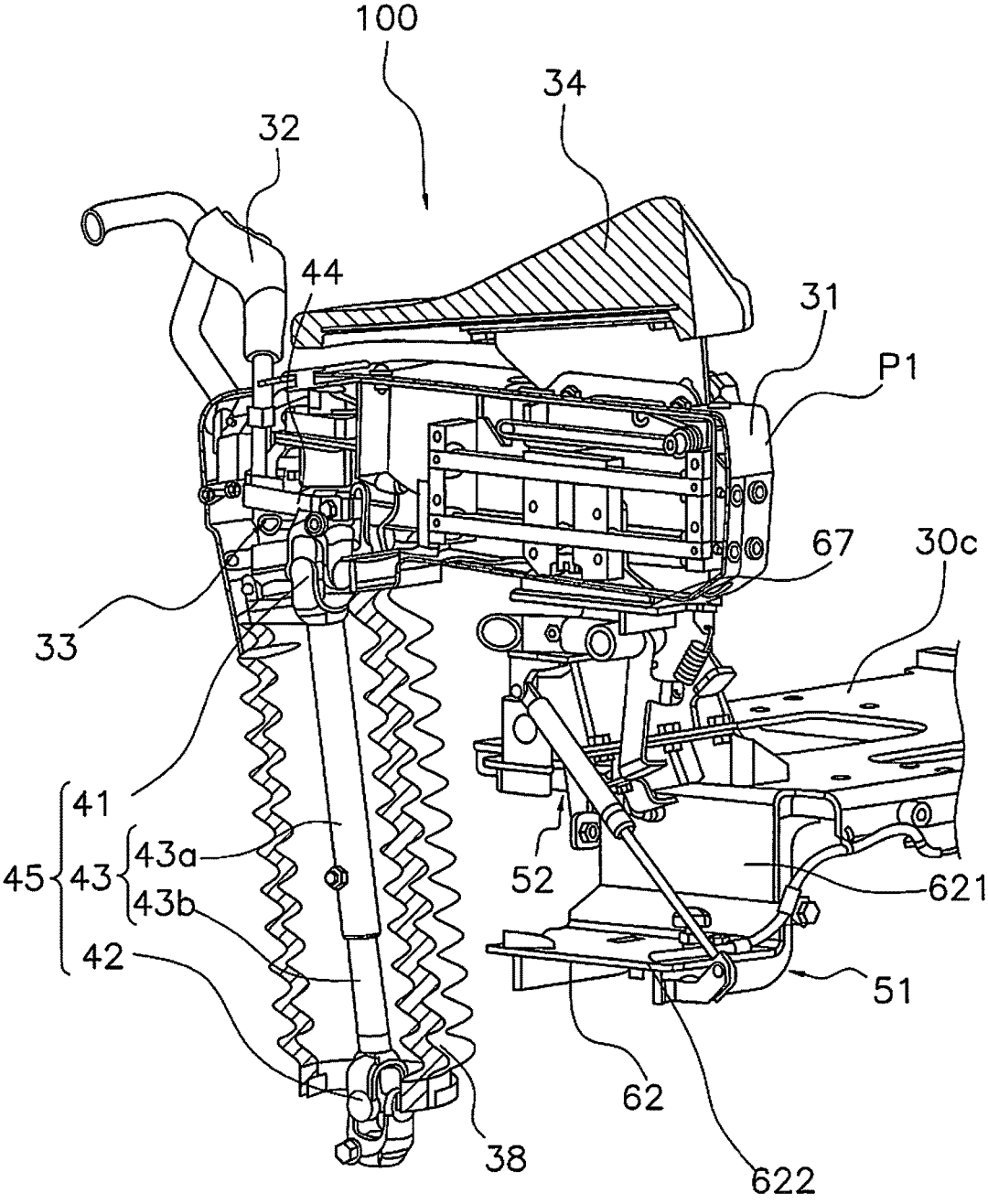
FIG. 6 is an oblique view of FIG. 5A.

As shown in FIG. 5A and FIG. 5B, the link 33 links the joystick 32 to the pilot valve 19. The link 33 mainly has a linking bar 44 and a universal joint 45.

The linking bar 44 is disposed in the forward and backward direction, and links the joystick 32 to the universal joint 45. The joystick 32 is disposed facing upward at the upper end of the linking bar 44. The universal joint 45 is attached facing downward on the lower side of the rear end of the linking bar 44. The linking bar 44 is supported by the console box 31 so as to be able to rotate in the left and right direction around the axis C, which is the up and down direction, of the rear end to which the universal joint 45 is attached.

As shown in FIG. 5A and FIG. 6, the universal joint 45 has a first joint 41, a second joint 42, and a telescoping part 43. The first joint 41 and the second joint 42 are disposed at both ends of the telescoping part 43. The telescoping part 43 is made up of an outer tube 43*a* and an inner tube 43*b*, and the outer tube 43*a* and the inner tube 43*b* are spline engaged.

FIG. 5B is a cross section along the E-E' line in FIG. 5A. As shown in FIG. 5B, a serrated groove is formed around the inside of the outer tube 43*a*, and a serrated groove that meshes with the serrated groove of the outer tube 43*a* is formed around the outside of the inner tube 43*b*. These grooves are formed in the lengthwise direction. This configuration causes the outer tube 43*a* and the inner tube 43*b* to be fixed to each other around the center axis F, allowing the operation of the joystick 32 to be transmitted. Also, the outer tube 43*a* and the inner tube 43*b* can move along the center axis F, which allow the telescoping part 43 to expand and contract.

The first joint 41 is attached on the lower side of the console box 31, and is linked by the linking bar 44 to the joystick 32. The second joint 42 is attached by being inserted into the floor 5*a* of the cab 5.

The second joint 42 of the link 33 is connected to the pilot valve 19. The operation of the joystick 32 is transmitted through the link 33 to the pilot valve 19, thus adjusting the pilot pressure inputted to a steering valve 20. The steering valve 20 adjusts the flow of fluid supplied to the steering cylinders 8 according to the inputted pilot pressure. Thus, steering operations can be performed by operating the joystick 32.

5-4. Armrest

As shown in FIG. 4, the armrest 34 is disposed on the upper side of the console box 31 via a bracket 341. In a state in which the console box 31 is disposed in the operation position P1, the armrest 34 is used to rest the arm of the operator sitting in the operator's seat 30.

5-5. Support Component

Figure 7:
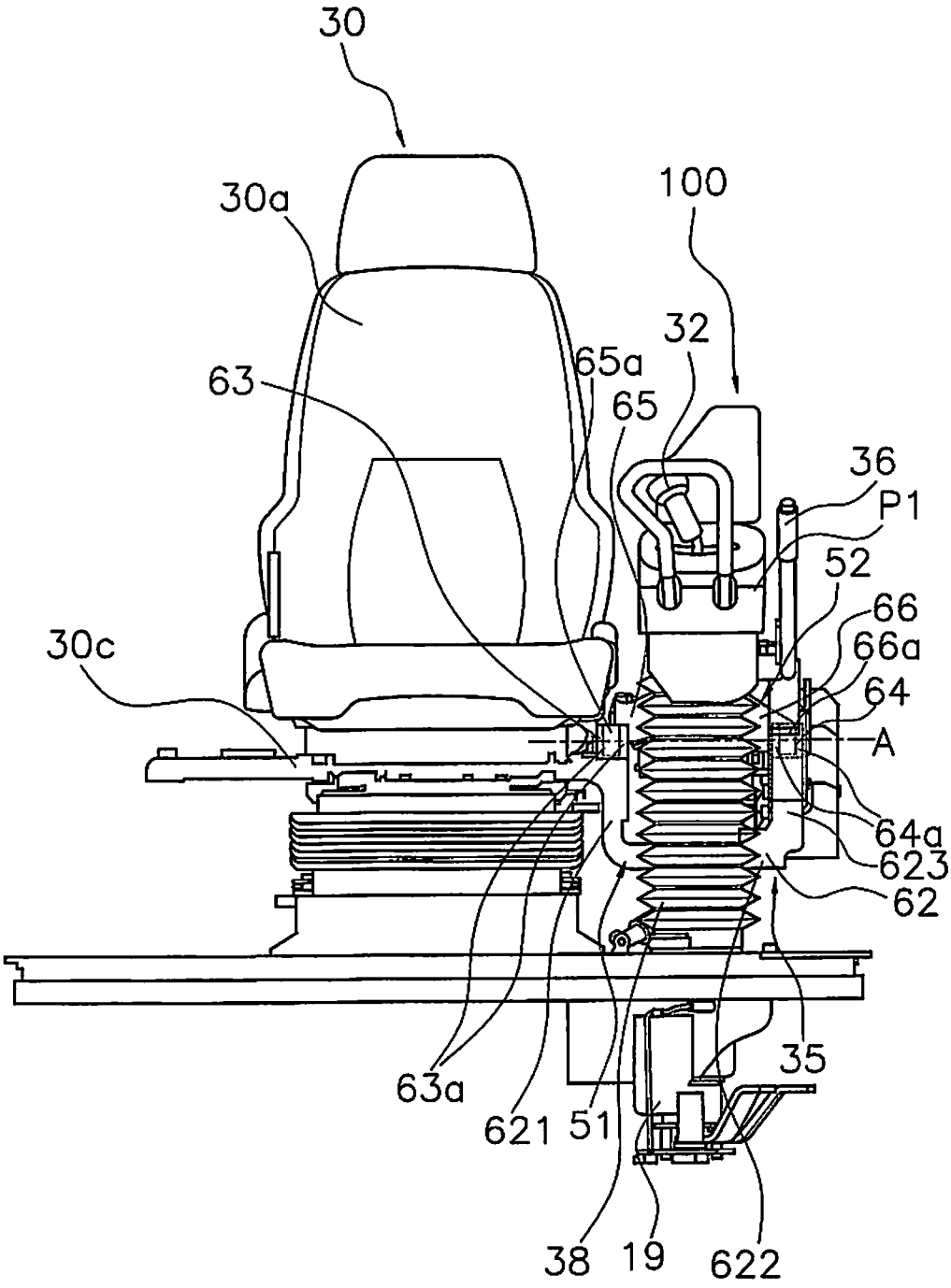
FIG. 7 is a front view of the operator's seat and the console box assembly in FIG. 4.
Figure 8:
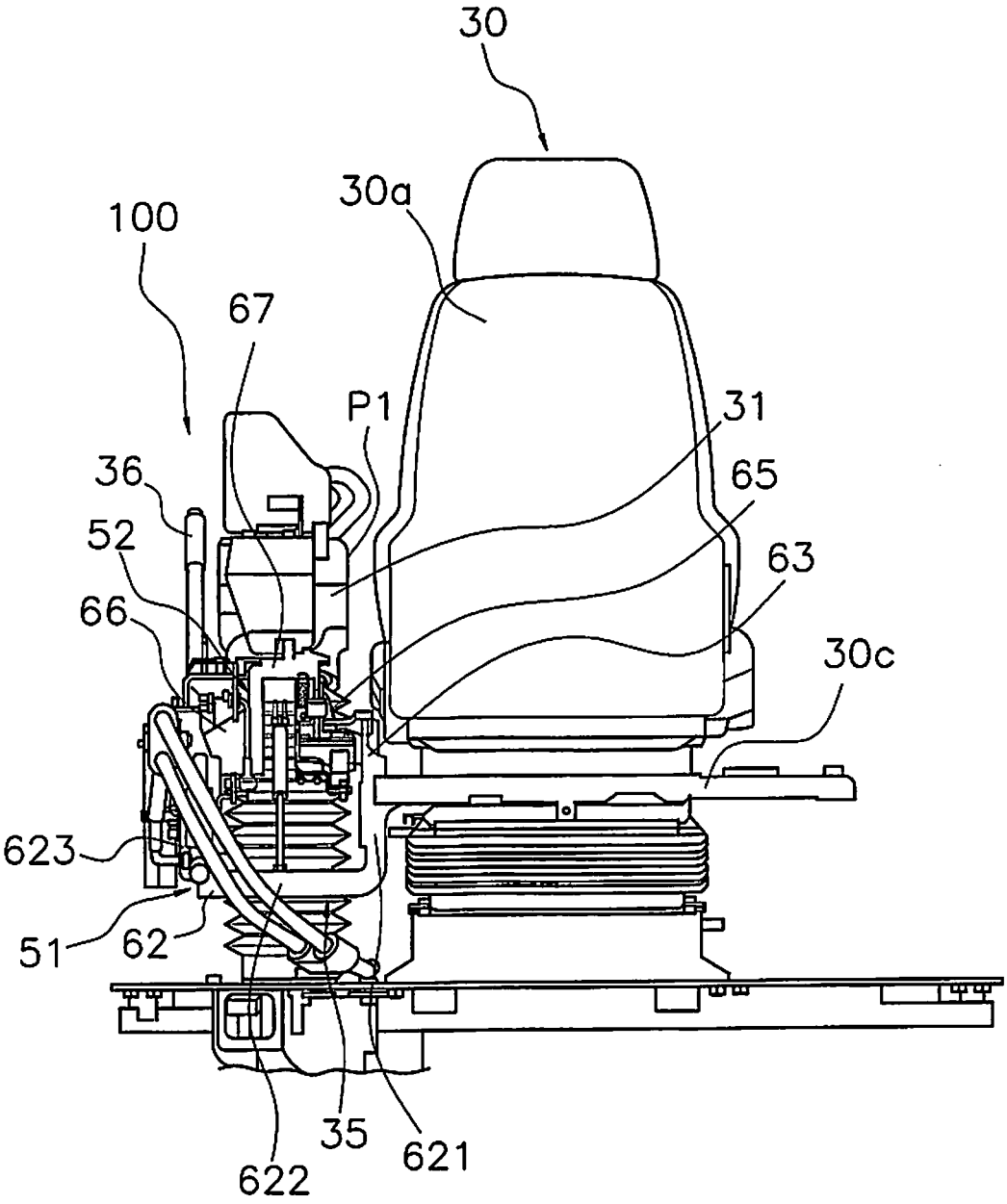
FIG. 8 is a rear view of the operator's seat and the console box assembly in FIG. 4.

FIG. 7 shows the area near the operator's seat 30 as seen from the front side. FIG. 8 shows the area near the operator's seat 30 as seen from the rear side.

As shown in FIGS. 4, 7, and 8, the support component 35 mainly has a fixed frame 51 and a rotary frame 52. The fixed frame 51 is fixed to the operator's seat 30. The rotary frame 52 is disposed on the upper side of the fixed frame 51, and is rotatably supported by the fixed frame 51. The rotary frame 52 slidably supports the console box 31.

a. Fixed Frame

As shown in FIG. 4, the fixed frame 51 is disposed on the rear side of the bellows 38 and below the console box 31. As shown in FIGS. 7 and 8, the fixed frame 51 is provided protruding toward the left side face from the lower frame 30*c* of the operator's seat 30.

As shown in FIG. 7, the fixed frame 51 has a fixed component 62, a first shaft support component 63, and a second shaft support component 64.

The fixed component 62 is connected to the lower frame 30*c*. The lower frame 30*c* protrudes to the left from the operator's seat 30, and the fixed component 62 is fixed to the left end of the lower frame 30*c*. The fixed component 62 is substantially U shaped when viewed in the forward and backward direction, and has a right side face 621, a bottom face 622, and a left side face 623.

The first shaft support component 63 is fixed to the right side face 621 of the fixed component 62. The second shaft support component 64 is fixed to the left side face 623 of the fixed component 62. The second shaft support component 64 is provided at a location opposite the first shaft support component 63 in the left and right direction. The first shaft support component 63 and the second shaft support component 64 rotatably support the rotary frame 52.

The first shaft support component 63 has two flat parts 63*a* disposed opposite each other with a specific space in between them in the left and right direction. A hole is formed in the left and right direction in each of the two flat parts 63*a*. A shaft that is fixed to the lower end 65*a* of a first rotary part 65 (discussed below) is inserted into these holes so that the first shaft support component 63 rotatably supports the first rotary part 65.

The second shaft support component 64 is fixed to the left side face 623 of the fixed component 62. The second shaft support component 64 has two flat parts 64*a* disposed opposite each other with a specific space in between them in the left and right direction. A hole is formed in the left and right direction in each of the two flat parts 64*a*. A shaft that is fixed to the lower end 66*a* of a second rotary part 66 (discussed below) is inserted into these holes so that the second shaft support component 64 rotatably supports the second rotary part 66.

b. Rotary Frame

The rotary frame 52 mainly has the first rotary part 65, the second rotary part 66, and a third rotary part 67 (see FIG. 8). The first rotary part 65 and the second rotary part 66 are disposed so as to be opposite and aligned in the left and right direction between the console box 31 and the fixed frame 51. The first rotary part 65 is disposed on the right side face 621 side, while the second rotary part 66 is disposed on the left side face 623 side. The first rotary part 65 and the second rotary part 66 are formed by being bent so that the space between them is substantially wider at the lower end than at the upper end.

The first rotary part 65 and the second rotary part 66 are linked at their upper ends to the third rotary part 67. The lower end 65*a* of the first rotary part 65 is inserted between the two flat parts 63*a* of the first shaft support component 63, and the shaft provided to the lower end 65*a* as discussed above is inserted into the holes in the flat parts 63*a*. The lower end 66*a* of the second rotary part 66 is inserted into the two flat parts 64*a* of the second shaft support component 64, and the shaft provided to the lower end 66*a* as discussed above is inserted into the holes in the flat parts 64*a*.

The shaft provided to the lower end 65*a* and the shaft provided to the lower end 66*a* are disposed coaxially (rotary shaft A) in the left and right direction.

The first rotary part 65 and the second rotary part 66 are able to rotate with respect to the fixed frame 51, around the rotary shaft A.

As shown in FIG. 8, the third rotary part 67 is linked to the upper end of the first rotary part 65 and to the upper end of the second rotary part 66, and slidably supports the console box 31. Therefore, the rotation of the first rotary part 65 and the second rotary part 66 causes the console box 31 to rotate as well.

The rotary shaft A of the console box 31 is the center of a first shaft 53 and a second shaft 54, and is shown in FIG. 4, FIG. 7, etc. As shown in FIG. 4, this rotary shaft A is on the lower side of the console box 31, and is disposed more to the front than the middle (see the line LM) of L1 between the front end 31*a* and the rear end 31*b* of the console box 31.

In the operation position P1, the console box 31 is substantially the same height as its front end 31*a* and rear end 31*b*, and is disposed substantially horizontally, as shown in FIG. 4.

Figure 9:
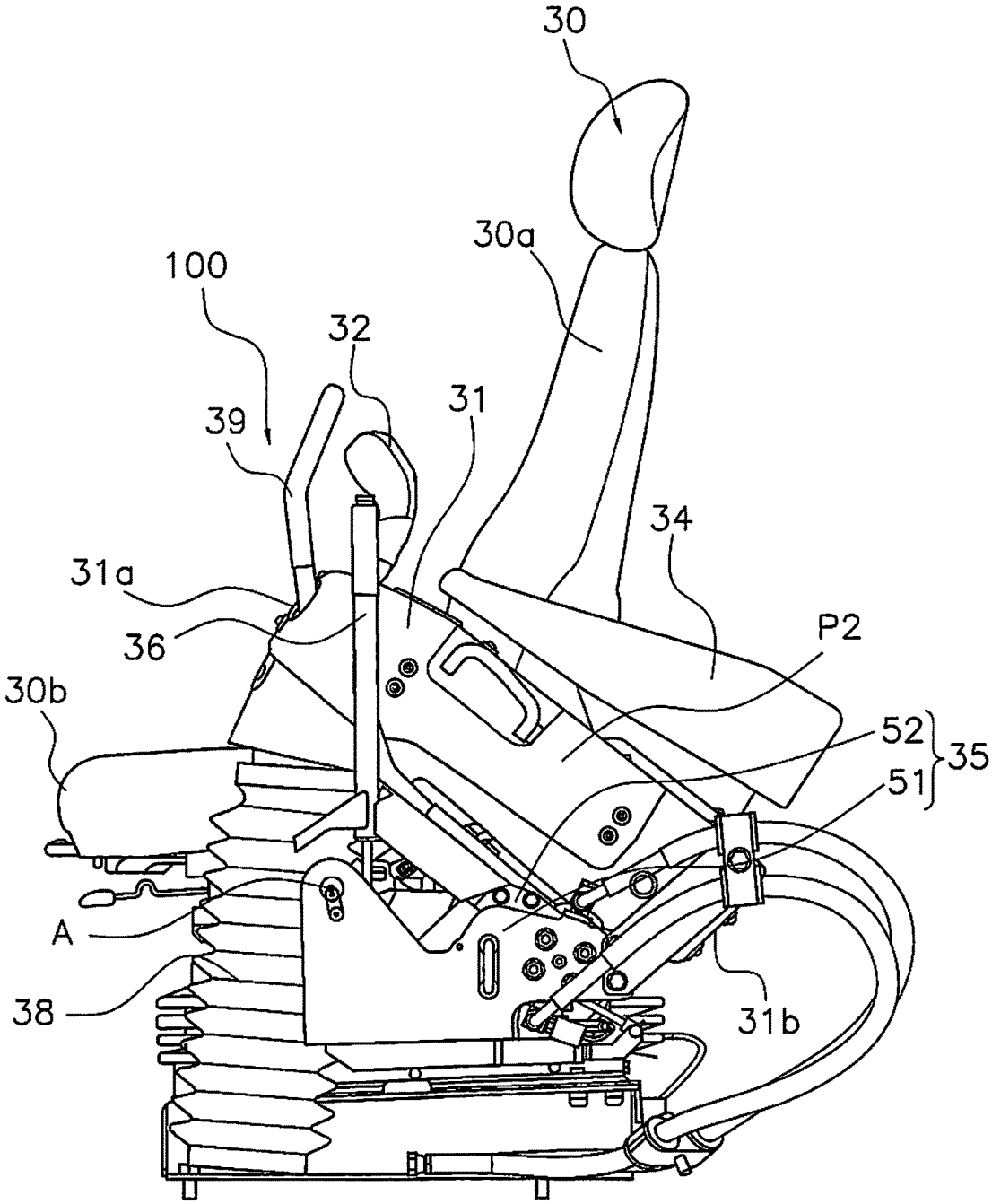
FIG. 9 is a side view of the operator's seat in FIG. 3 and the console box assembly in a state in which the console box is disposed in the retracted position.

FIG. 9 is a side view of the console box assembly 100 when the console box 31 is disposed in a retracted position P2. When the operator grasps the rotary lever 36 (discussed below) in a state in which the console box 31 is disposed in the operation position P1 as in FIG. 4, and rotates the rotary lever 36 rearward as indicated by the arrow A1 in FIG. 4, the console box 31 rotates around the rotary shaft A until the console box 31*t* is disposed in the retracted position P2.

Figure 10:
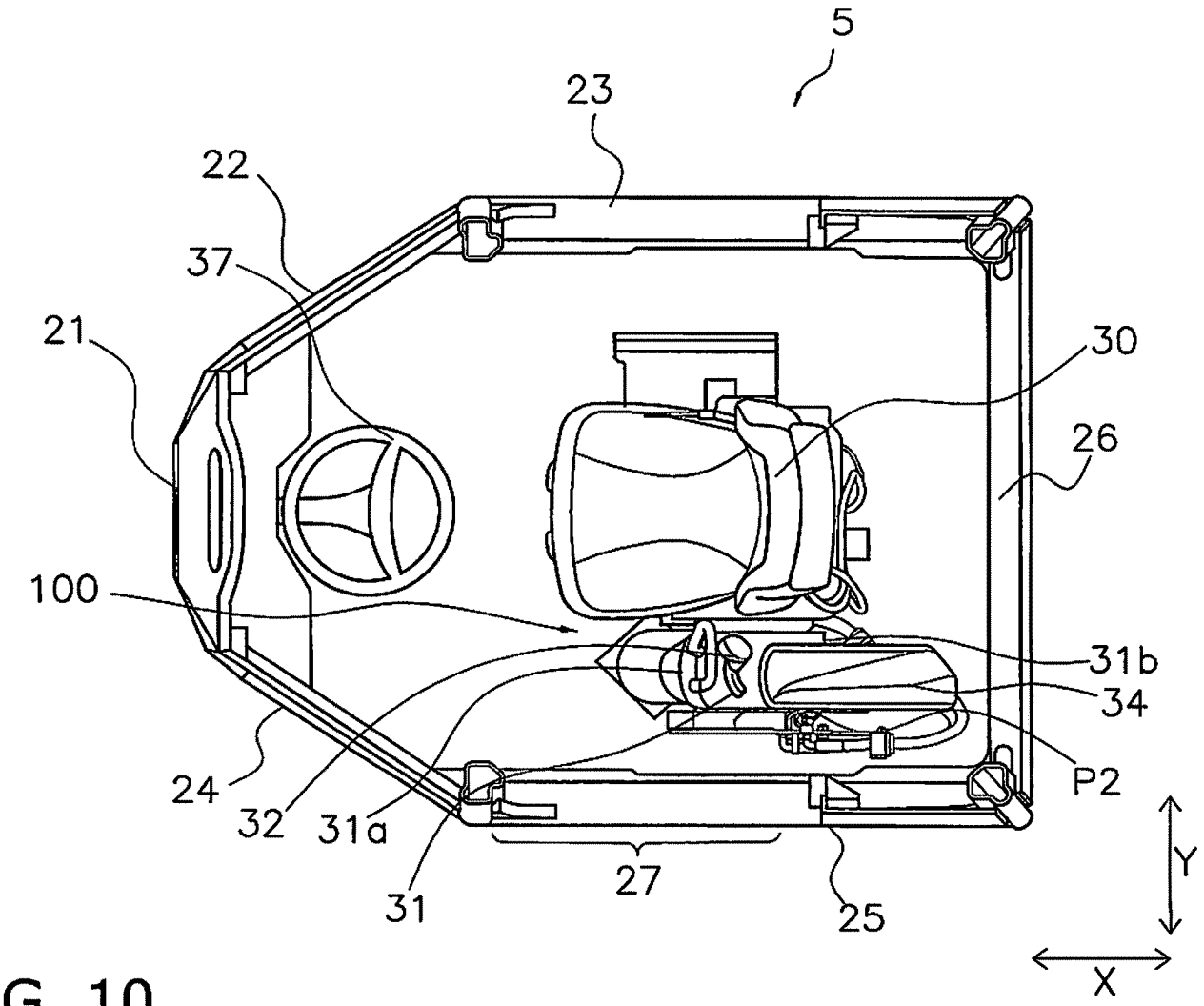
FIG. 10 is a top view of the state when the console box is disposed in the retracted position.
Figure 11:
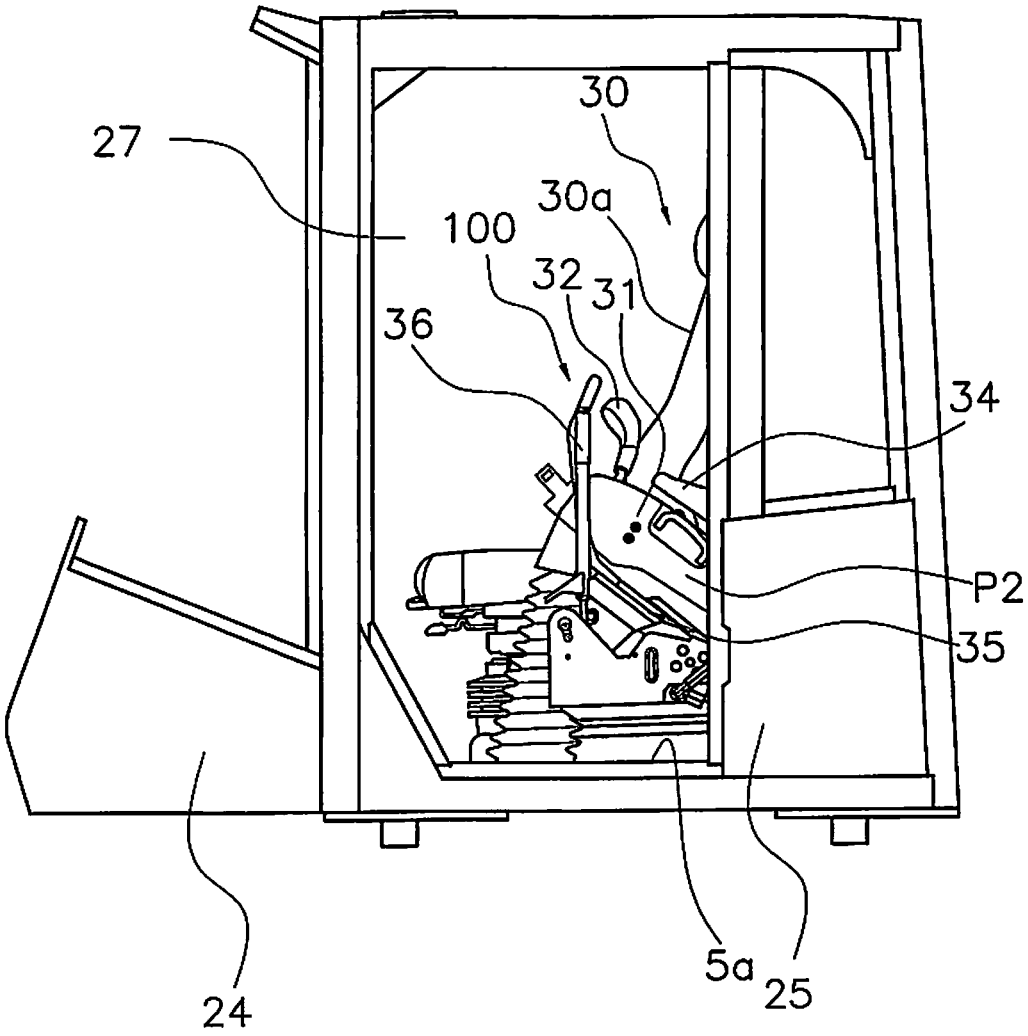
FIG. 11 is a left side view of the configuration of the cab in FIG. 1 in a state in which the console box is disposed in the retracted position.

FIG. 10 is a top view of the state when the console box 31 is disposed in the retracted position P2. FIG. 11 is a left side view of FIG. 10.

As shown in FIG. 10, in the retracted position P2, the console box 31 is disposed at an angle. More precisely, the rear end 31*b* of the console box 31 is located lower than the front end 31*a*.

As shown in FIGS. 3 and 11, when the console box 31 is rotated rearward to the retracted position P2, this makes it easier for the operator to move in and out of the door opening 27.

c. Slide Mechanism

Figure 12:
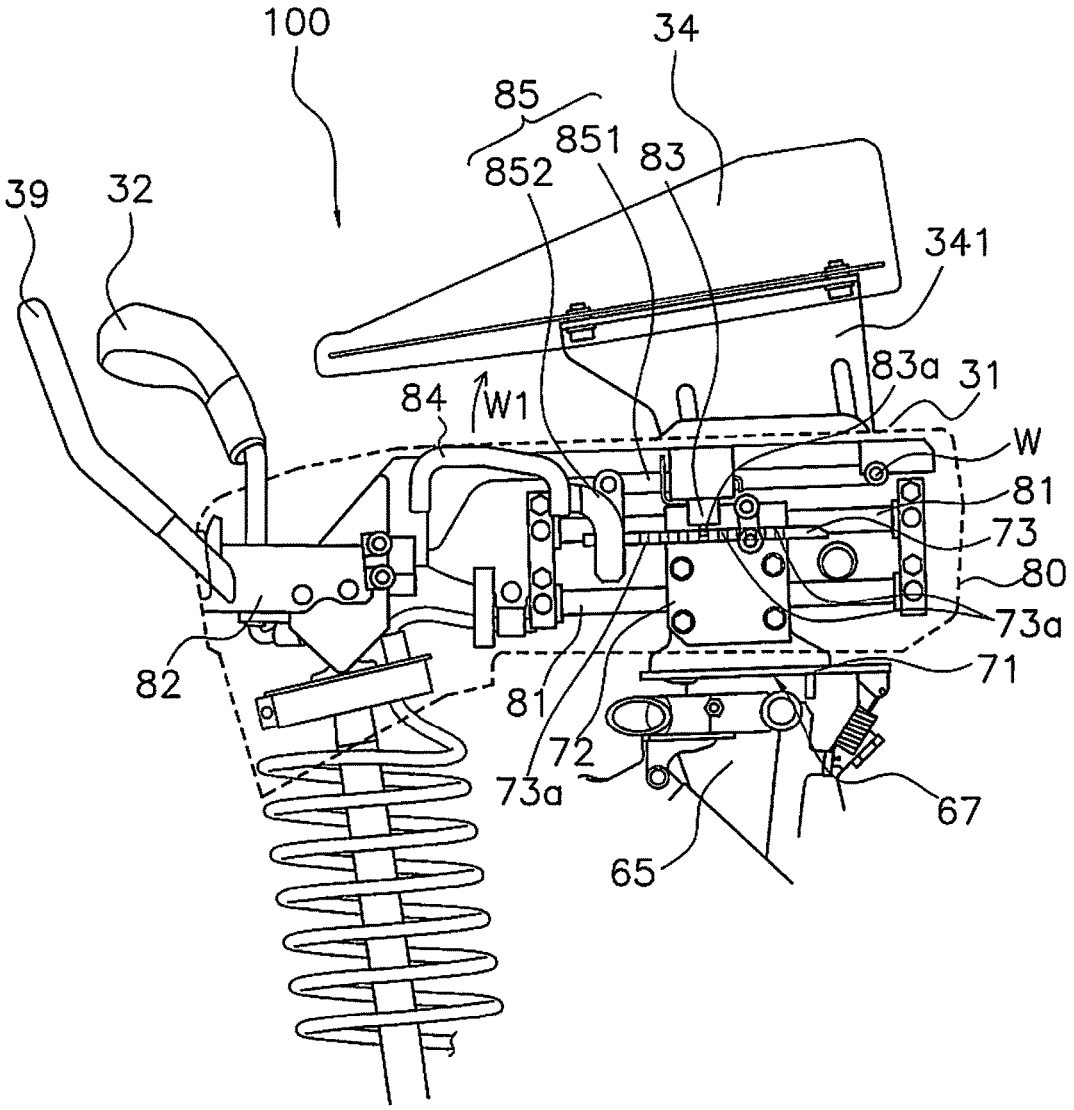
FIG. 12 shows the internal configuration of the console box in FIG. 4.

FIG. 12 shows the slide mechanism of the console box 31. As shown in this drawing, the third rotary part 67 has a connection 71, a rail support member 72, and a positioning member 73.

The connection 71 is connected to the upper ends of the first rotary part 65 and the second rotary part 66. The rail support member 72 is a cuboid member, is fixed to the connection 71 on the upper side of the connection 71, and slidably supports two rail members 81 (discussed below). The positioning member 73 is a flat member that is longer in the forward and backward direction, and is fixed to the rail support member 72. A plurality of holes 73*a* formed in the up and down direction are provided to the positioning member 73 in the forward and backward direction.

Meanwhile, the console box 31 mainly has an outer frame 80 (indicated by a dotted line in FIG. 12), two rail members 81 fixed to the outer frame 80, a front frame part 82, a pin component 83 fixed to the outer frame 80, a slide grip 84, and a linking component 85. The two rail members 81 are provided running in the forward and backward direction, and are slidably supported in the forward and backward direction by a rail support member 72. The front frame part 82 is provided to the front part on the inside of the outer frame 80, and rotatably supports the joystick 32, the linking bar 44, and so forth.

The pin 83 is disposed in the up and down direction, and a lower end 83*a* of the pin 83 fits into the above-mentioned holes 73*a* of the positioning member 73. This fixes the position of the console box 31 in the forward and backward direction. The slide grip 84 is provided on the left side face side of the outer frame 80 of the console box 31.

The linking component 85 links the slide grip 84 to the pin 83. The linking component 85 has a post-shaped portion 851 that is provided in the forward and backward direction and to which the pin 83 is fixed, and a linking portion 852 that links the post-shaped portion 851 to the slide grip 84. The post-shaped portion 851 is provided rotatably with respect to the rail members 81 around the rotary shaft W of its rear end.

When the console box 31 is slid in the forward and backward direction, the slide grip 84 is grasped and lifted by the operator. Consequently, the linking component 85 rotates upward (in the direction of the arrow WI) around the rotary shaft W, and the pin 83 fixed to the linking component 85 also rotates upward. The rotation of the pin 83 causes its lower end 83*a* to be pulled upward and out of the holes 73*a*, resulting in a state in which the fixing is released. In this state, the rail members 81 can slide with respect to the rail support member 72, so the console box 31 can be slid in the forward and backward direction. When the console box 31 is moved downward at the desired position in the forward and backward direction, the lower end 83*a* of the pin 83 fits into the holes 73*a*, and the position of the console box 31 is fixed with respect to the third rotary part 67.

Figure 13A:
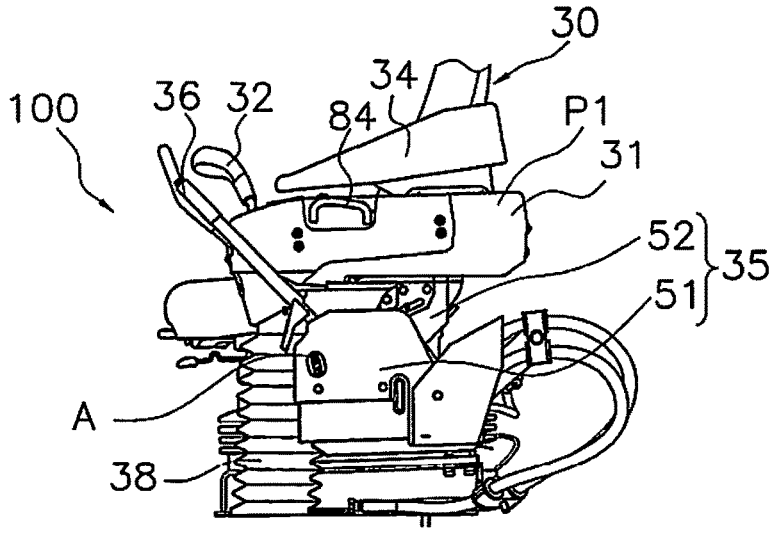
FIGS. 13A to 13C are side views illustrating the center of gravity position in the operation position when the console box in FIG. 3 has been slid.
Figure 13B:
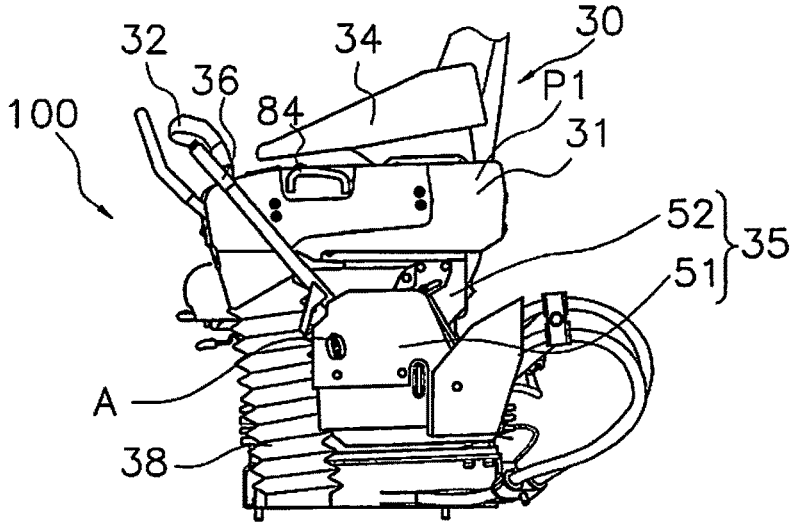
Figure 13C:
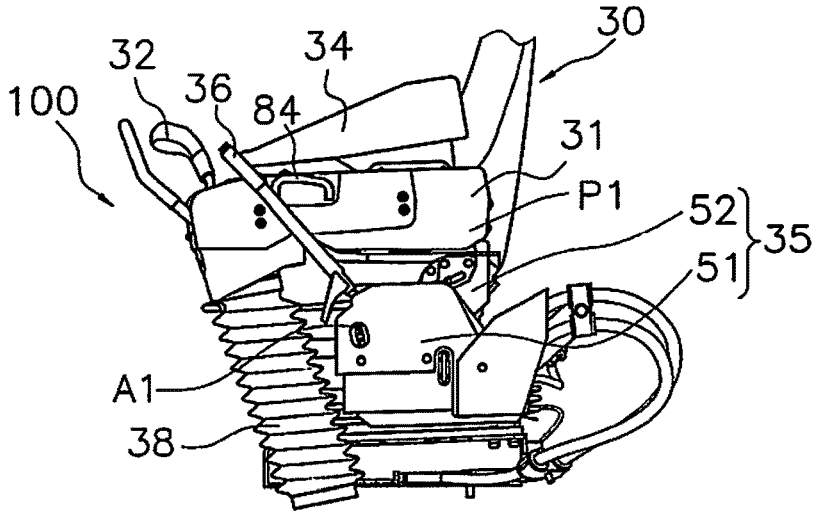

FIGS. 13A to 13C are side views of the state when the console box 31 has been slid in the operation position P1. FIG. 13A is a side view of the console box assembly 100 in a state in which the console box 31 has been moved all the way to the rear in the operation position. FIG. 13B is a side view of the console box assembly 100 in a state in which the console box 31 has been moved to an intermediate position in the forward and backward direction in the operation position. FIG. 13C is a side view of the console box assembly 100 in a state in which the console box 31 has been moved all the way to the front in the operation position. As shown in FIGS. 13A to 13C, the console box 31 slides in the forward and backward direction.

Figure 14A:
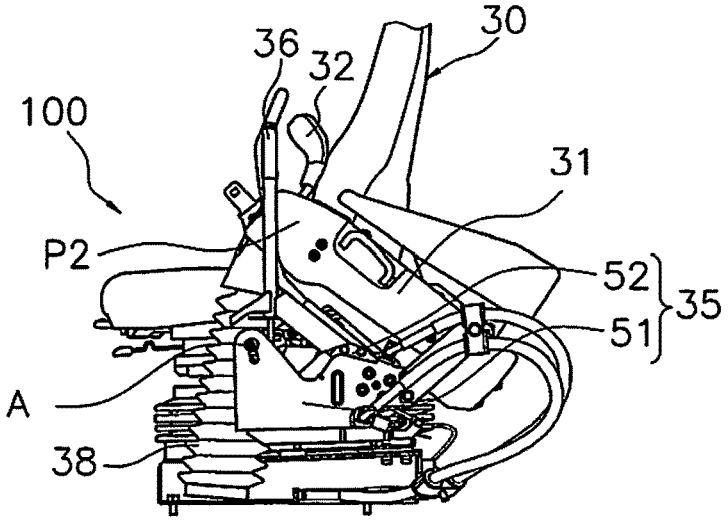
FIGS. 14A to 14C are side views illustrating the center of gravity position in the retracted position when the console box in FIG. 3 has been slid.
Figure 14B:
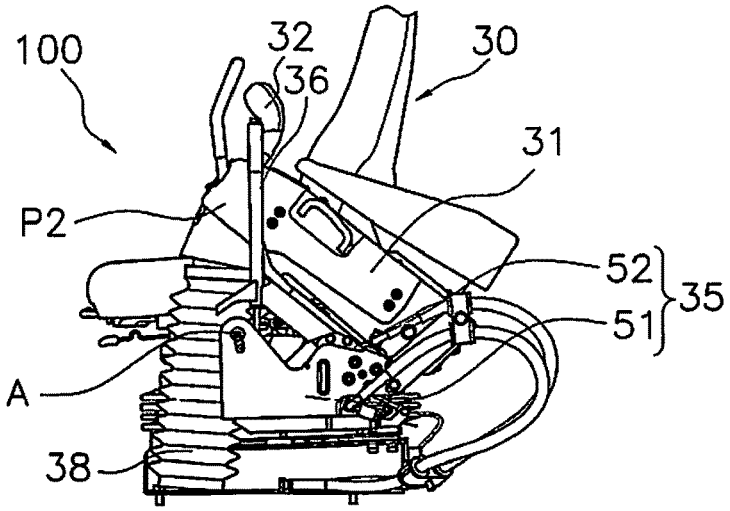
Figure 14C:
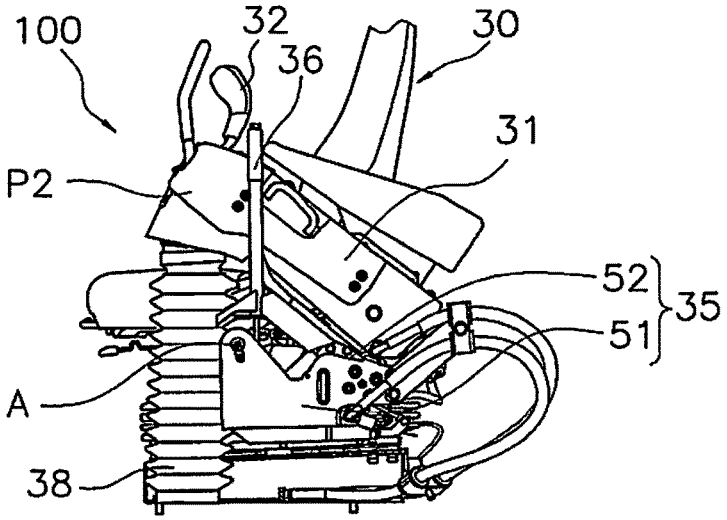

FIGS. 14A to 14C are side views of the state when the console box 31 has been slide in the retracted position P2. FIG. 14A is a side view of the console box assembly 100 in a state in which the console box 31 has been moved all the way to the rear in the retracted position P2. FIG. 14B is a side view of the console box assembly 100 in a state in which the console box 31 has been moved to an intermediate position in the forward and backward direction in the refracted position. FIG. 14C is a side view of the console box assembly 100 in a state in which the console box 31 has been moved all the way to the front in the retracted position.

As shown in FIGS. 14A to 14C, the console box 31 slides in the forward and backward direction.

As discussed above, the console box 31 in this exemplary embodiment is provided slidably in the forward and backward direction and rotatably in the forward and backward direction.

5-6. Rotary Lever

The rotary lever 36 is grasped by the operator when the console box 31 is rotated.

The rotary lever 36 is linked to the rotary frame 52, and the rotary frame 52 can be rotated rearward with respect to the fixed frame 51 by rotating the rotary lever 36 rearward.

As shown in FIG. 3, in a state in which the console box 31 is disposed in the operation position P1, since the rotary lever 36 is blocking the passage from the operator's seat 30 to the door opening 27, the operator cannot get into or out of the seat. On the other hand, in a state in which the console box 31 is disposed in the retracted position P2, since the rotary lever 36 is retracted from the passage between the operator's seat 30 and the door opening 27, the operator can get in and out.

5-7. Bellows 38

As shown in FIG. 4, the bellows 38 is disposed between the floor 5*a* and the lower side of the console box 31 near the front end 31*a*.

The bellows 38 is fixed to the floor 5*a* at its lower end 38*b*. The bellows 38 is also linked to the console box 31 at its upper end 38*a*.

Figure 15:
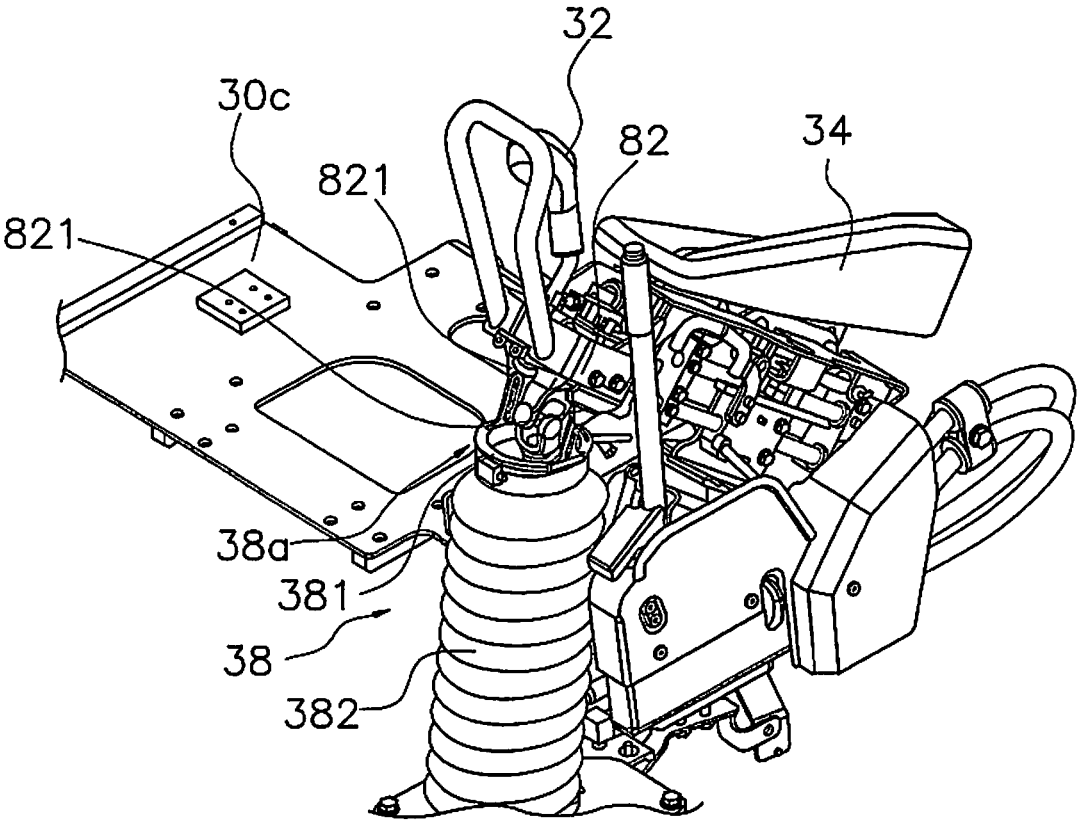
FIG. 15 is an oblique view of the state when the outer frame of the console box in FIG. 9 is not depicted.

FIG. 15 is an oblique view of FIG. 9, showing the configuration of the upper end 38*a* of the bellows 38. FIG. 15 shows the state when the console box 31 is disposed in the retracted position P2, and shows the state when the slide position is in the middle, just as in FIG. 14B. In FIG. 15, the outer frame 80 of the console box 31 is not depicted, for the sake of description. As shown in FIG. 15, the front frame part 82 of the console box 31 has a pair of console-side linking components 821 provided opposite each other in the left and right direction. As shown in FIGS. 12 and 15, the console-side linking components 821 are in the form of inverted triangles in side view.

Figure 16:
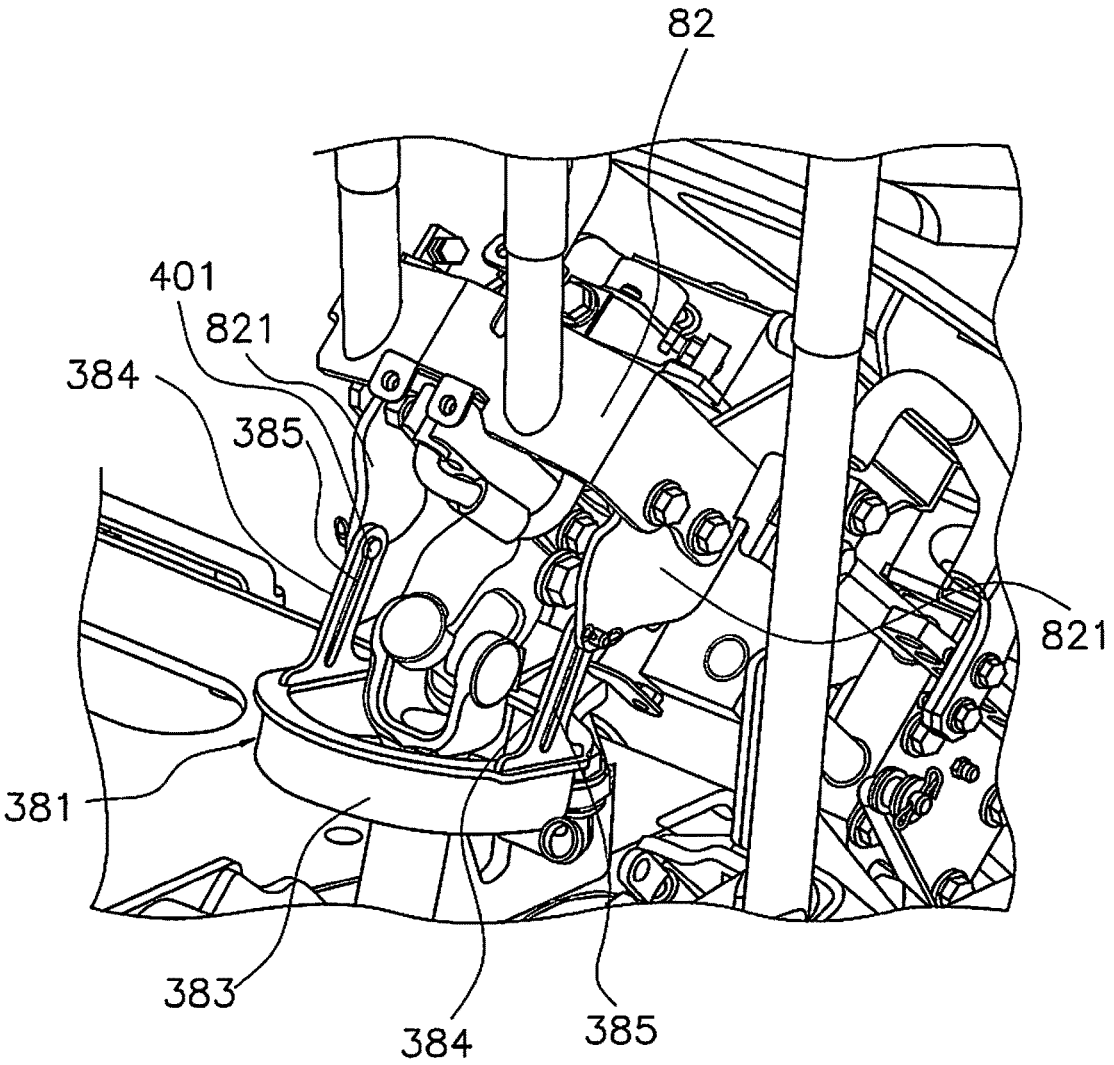
FIG. 16 is an oblique view of the area near the upper end of the bellows in FIG. 15.

The bellows 38 has an upper frame 381 provided to the upper end 38*a*, and a bellows main body 382. FIG. 16 shows the upper frame 381. The upper frame 381 has an annular part 383 and a pair of bellows-side linking components 384 protruding upward from the annular part 383.

The bellows main body 382 is attached around the annular part 383. The bellows main body 382 is formed from an elastic member.

The bellows-side linking components 384 are disposed opposite each other in the left and right direction, and are formed protruding upward from the annular part 383. A linear slot 385 is formed in each of the bellows-side linking components 384. The slots 385 pass through the bellows-side linking components 384 in the left and right direction.

Figure 17:
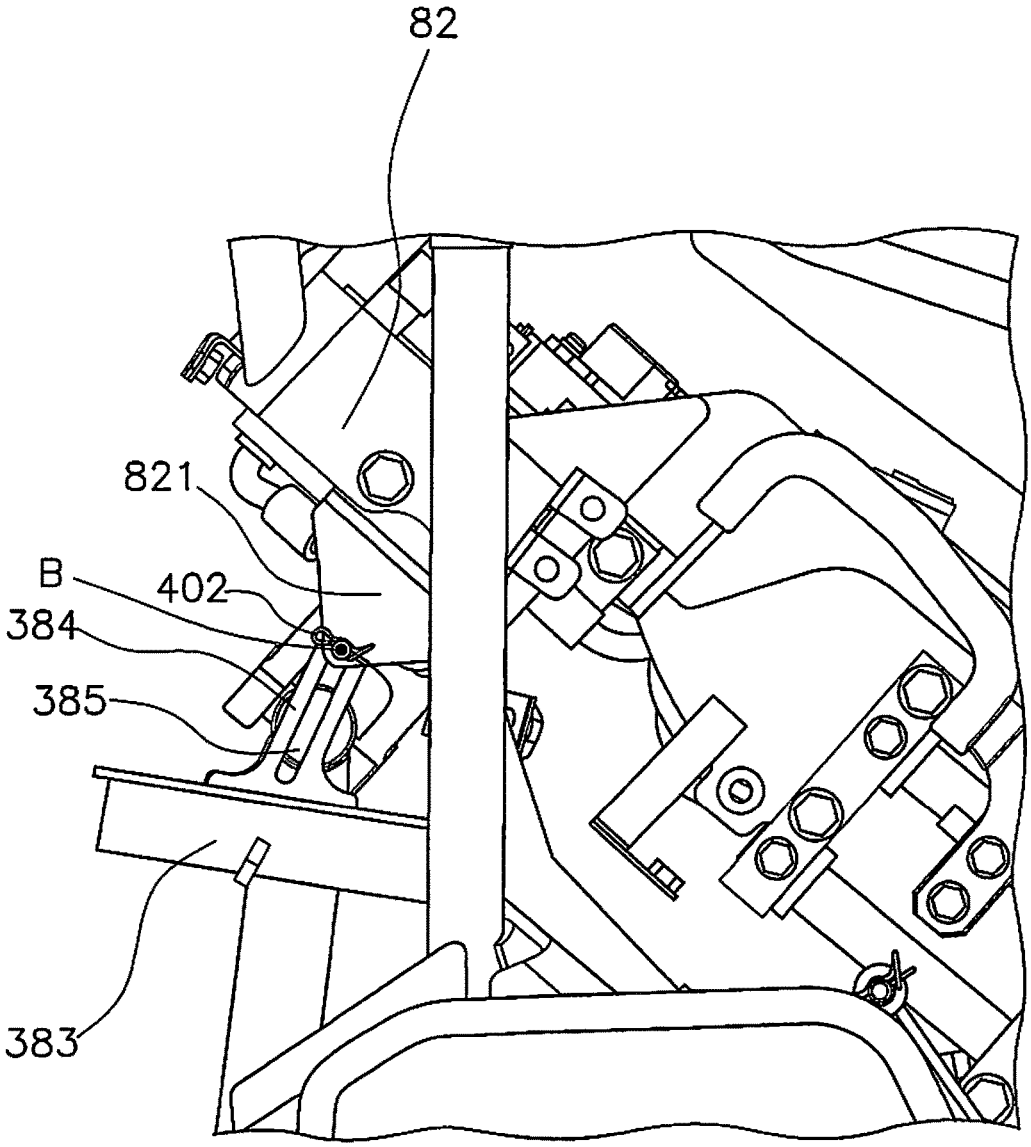
FIG. 17 is a side view of FIG. 16.

FIG. 17 is a left side view of FIG. 16. As shown in FIG. 17, in side view the bellows-side linking components 384 are not formed perpendicular to the annular part 383, and are instead formed inclined to the rear. Along with these bellows-side linking components 384, the slots 385 are also formed inclined to the rear from perpendicularly above the annular part 383. This inclination is provided so as to accommodate the rearward rotation of the console box 31.

Figure 18:
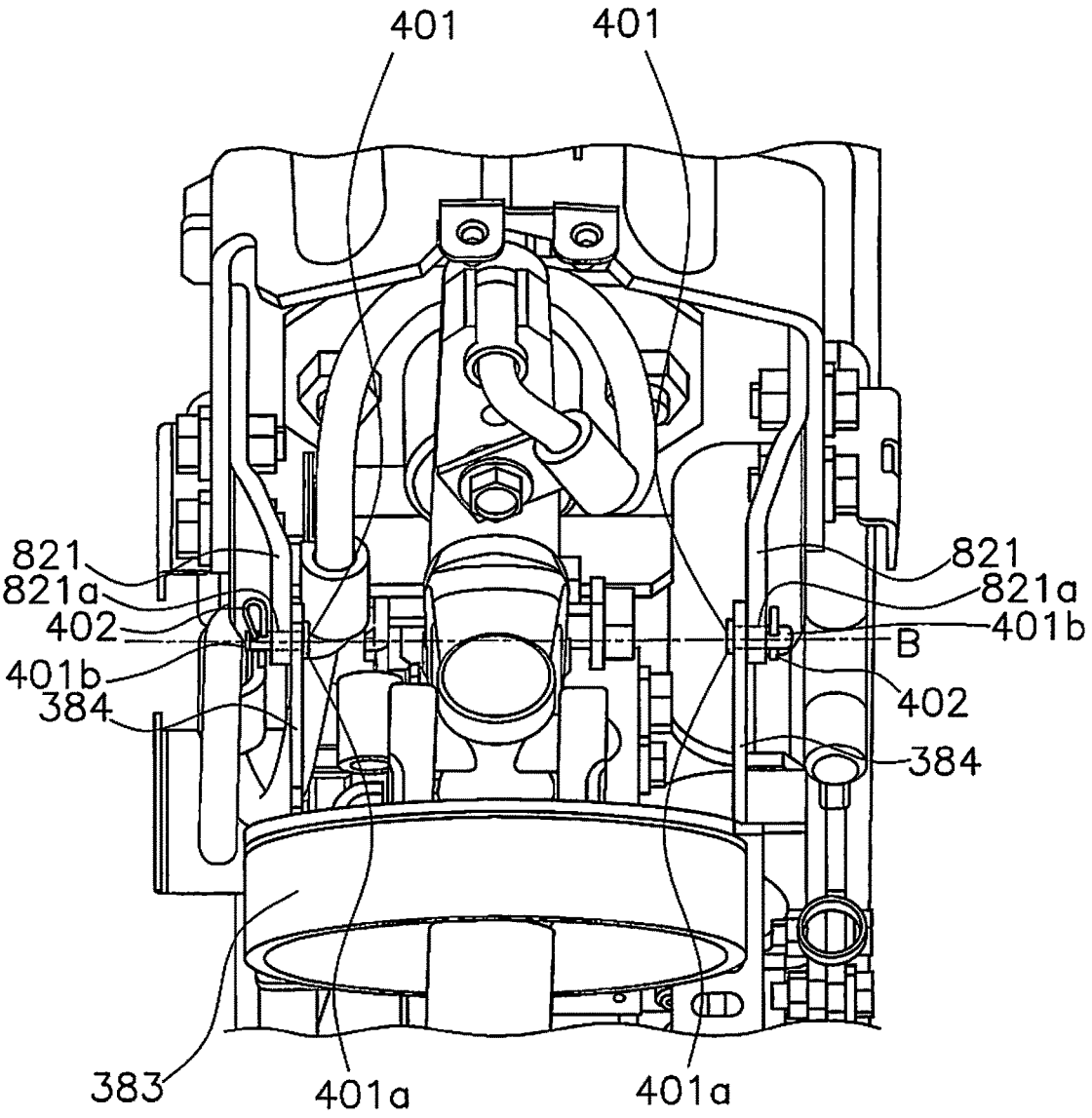
FIG. 18 is a top view of FIG. 16.

FIG. 18 is a front view of FIG. 16. As shown in FIG. 18, circular through-holes 821*a* are formed in the left and right direction at the lower end of the console-side linking components 821. The bellows-side linking components 384 are disposed on the inside of the console-side linking components 821, and pins 401 that are inserted into the slots 385 and the through-holes 821*a* are provided. The pins 401 have heads 401*a*, and are inserted from the inside into the slots 385 and the through-holes 821*a* so that the heads 401*a* are disposed on the inside. Cotter pins 402 are inserted on the outside of the through-holes 821*a* of the shaft parts 401*b* of the pins 401.

With this configuration, the upper end 38*a* of the bellows 38 is able to rotate with respect to the console box 31, with the pins 401 serving as the rotary shaft B. Also, the upper end 38*a* of the bellows 38 is able to slide with respect to the console box 31 by having the pins 401 slide through the slots 385.

As shown in FIGS. 13 and 14, the console box 31 in this embodiment is configured to be capable of sliding in the forward and backward direction and rotating in the forward and backward direction. Also, the lower end of the bellows 38 is fixed to the floor 5*a* in order to prevent mud or the like from penetrating.

Accordingly, unlike in this exemplary embodiment, for example, when the upper end 38*a* of the bellows 38 is fixed directly to the console box 31, the bellows 38 will rotate and expand forward and backward in reference to the lower end in the state shown in FIGS. 13C and 14A, and will contract in the state shown in FIG. 13A.

With this exemplary embodiment, by contrast, the upper end 38*a* of the bellows 38 can slide and rotate with respect to the console box 31, and this reduces the amount of expansion, contraction, and rotation of the bellows 38.

As shown in FIG. 4, the wheel loader 1 (an example of a work vehicle) in this exemplary embodiment comprises the console box 31 and the bellows 38. The console box 31 is disposed on the side of the operator's seat 30, and is able to rotate in the forward and backward direction, around the rotary shaft A (an example of a first rotary shaft) running in the left and right direction, between the operation position P1 in which the console box 31 is disposed horizontally and the retracted position P2 in which the console box 31 is rotated rearward from the operation position P1. The bellows 38 has the lower end 38*b* and the upper end 38*a*. The lower end 38*b* is fixed to the floor 5*a* of the operator's seat 30. The upper end 38*a* is linked to the console box 31 so as to be able to rotate in the forward and backward direction around the rotary shaft B (an example of a second rotary shaft) running in the left and right direction.

Thus, the upper end 38*a* of the bellows 38 is rotatably linked to the console box 31, so when the console box 31 rotates, the upper end 38*a* of the bellows 38 does not rotate by the same angle as the console box 31.

Consequently, distortion during rotation of the console box 31 is suppressed, and there is less deterioration of the bellows 38.

As shown in FIGS. 15 and 16, with the wheel loader 1 (an example of a work vehicle) in this exemplary embodiment, the console box 31 has the pair of console-side linking components 821 (an example of a linking component). The pair of through-holes 821*a* (an example of a first through-hole) that are opposite each other in the left and right direction are formed in the console-side linking components 821. The pair of slots 385 (an example of a second through-hole) that are opposite each other in the left and right direction are formed in the upper end 38*a* of the bellows 38. The pin 401 is inserted into the through-hole 821*a* and slot 385 in each of the left and right linking components 384 and 421.

Consequently, in the rotation of the console box 31, the upper end 38*a* of the bellows 38 rotates relatively with respect to the console box 31 around the pins 401, so there is less distortion of the bellows 38.

As shown in FIG. 16, with the wheel loader 1 (an example of a work vehicle) in this exemplary embodiment, the pins 401 are inserted slidably in the slots 385.

Consequently, the upper end 38*a* of the bellows 38 are such that the pins 401 can slide through the slots 385 in the rotation of the console box 31, so there is less rotation, expansion, and contraction of the bellows.

As shown in FIG. 17, with the wheel loader 1 (an example of a work vehicle) in this exemplary embodiment, the slots 385 are formed in a linear shape, facing upward and obliquely reward from below.

Consequently, the pins 401 can slide more smoothly through the slots 385 as the console box 31 rotates rearward.

As shown in FIG. 4, the wheel loader 1 (an example of a work vehicle) in this exemplary embodiment further comprises the support component 35. The support component 35 has the rotary shaft A (an example of a first rotary shaft), and rotatably supports the console box 31. The console box 31 is configured to be able to slide in the forward and backward direction with respect to the support component 35.

Even with a configuration that allows the console box 31 to rotate and slide, rotation, expansion, and contraction of the bellows 38 can be reduced.

As shown in FIG. 5, the wheel loader 1 (an example of a work vehicle) in this exemplary embodiment further comprises the joystick 32 (an example of an operation lever), the steering cylinders 8 (an example of a hydraulic actuator), the pilot valve 19 (an example of a control valve), and the link 33. The joystick 32 is provided to the console box 31. The steering cylinders 8 change the steering angle according to the supplied fluid. The pilot valve 19 is disposed on the lower side of the floor 5*a* of the operator's seat 30, and controls the fluid supplied to the steering cylinders 8. The link 33 links the joystick 32 to the pilot valve 19. The bellows 38 covers the outside of the link 33.

Consequently, there is less distortion of the bellows 38, so the bellows 38 does not interfere with the link 33 as much, and deterioration of the bellows can be suppressed.

An exemplary embodiment of the present invention is described above, but the present invention is not limited to or by the above exemplary embodiment, and various modifications are possible without departing from the gist of the invention.

In the above exemplary embodiment, the pins 401 are inserted into the through-holes 821*a* and the slots 385, but the pins 401 may instead be fixed by welding or the like to either the console-side linking components 821 or the bellows-side linking components 384.

Figure 19A:
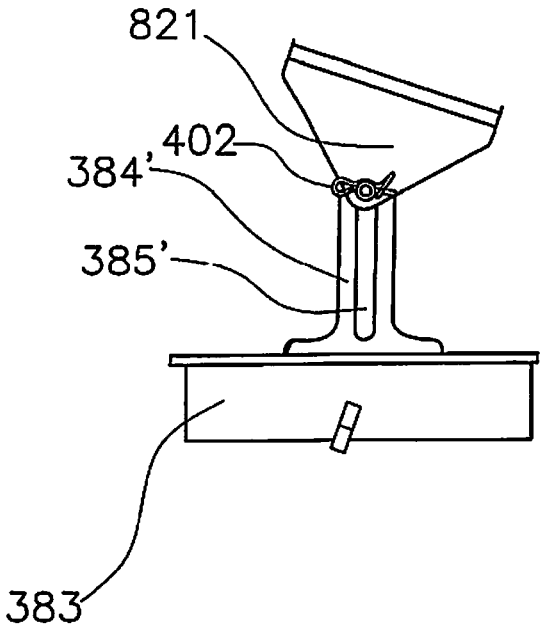
FIGS. 19A and 19B show modification examples of the bellows in an exemplary embodiment pertaining to the present invention.

In the above exemplary embodiment, bellows-side linking components 384 and the slots 385 are formed inclined from the perpendicular direction with respect to the annular part 383 in side view, but may instead be formed perpendicular to the annular part 383, as with the bellows-side linking components 384' and the slots 385' shown in FIG. 19A.

Figure 19B:
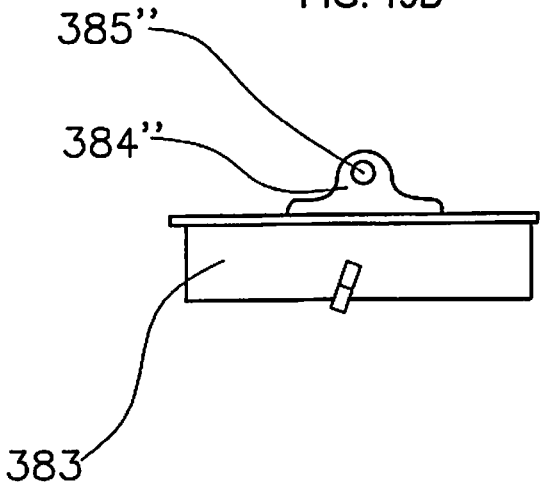

In the above exemplary embodiment, the slots 385 are formed in the bellows-side linking components 384, but as shown in FIG. 19B, bellows-side linking components 384" may be provided in which through-holes 385" have been formed, instead of the slots 385.

With the through-holes 385", effect of reducing distortion to the bellows 38 is not as good as with the slots 385, but distortion to the bellows 38 can be reduced compared to a conventional configuration involving fixing directly to the console box 31.

In the above exemplary embodiment, cylindrical through-holes 821*a* are formed in the console-side linking components 821, and slots 305 are formed in the bellows-side linking components 384, but the reverse is also possible. That is, slots may be formed in the console-side linking components 821, and cylindrical through-holes may be formed in the bellows-side linking components 384. Furthermore, slots may be formed in both the console-side linking components 821 and the bellows-side linking components 384.

In the above exemplary embodiment, the bellows-side linking components 384 are disposed on the inside of the console-side linking components 821, but the reverse is also possible.

With the wheel loader 1 in the above exemplary embodiment, the joystick 32 of the console box 31 is provided as an example of an operation lever, but this is not limited to the joystick 32. Furthermore, the operation lever itself need not be provided, and the configuration of this embodiment can be applied as long as the console box 31 is provided to the side of the operator's seat 30.

With the wheel loader 1 in the above exemplary embodiment, the link 33 is provided, and the operation of the joystick 32 is transmitted mechanically to the pilot valve 19, but the configuration may be such that no link 33 is provided, and the operation is transmitted electrically. In this case, the transmission may be done by wire or wirelessly.

With the wheel loader 1 in the above exemplary embodiment, the pilot valve 19 is provided as an example of a control valve, but this is not limited to the pilot valve 19. For example, the pilot valve 19 may not be provided, the link 33 may be connected to the steering valve 20 (an example of a control valve), and the steering valve 20 may be operated directly with the joystick 32.

In the above exemplary embodiment, the armrest 34 is provided on the upper side of the console box 31, but the armrest 34 need not be provided. Also, as shown in FIGS. 9 and 10, the rear end of the armrest 34 protrudes rearward from the rear end 31*b* of the console box 31, but the armrest 34 may be formed so that there is no protrusion.

In the above exemplary embodiment, a wheel loader is used as an example of a work vehicle, but this may instead be a dump truck, a hydraulic excavator, or the like.

In the above exemplary embodiment, the wheel loader 1 is given as an example of a work vehicle, and the steering wheel 37 is disposed inside the cab 5, but depending on the work vehicle, there may be no steering wheel 37.

In the above exemplary embodiment, lower end 38*b* of the bellows 38 are fixed to the floor 5*a*, but this is not the only option. The lower end 38*b* of the bellows 38 may be fixed to a bracket or step provided to the floor 5*a*. In other words, the lower end 38*b* of the bellows 38 should fixed on the floor side.

The work vehicle pertaining to the present invention has the effect of making it possible to suppress deterioration of a bellows, and can be broadly applied to various kinds of work vehicle, such as a wheel loader.

The invention claimed is:

1. A work vehicle, comprising:

a console box disposed on the side of an operator's seat, the console box being rotatable in the forward and backward direction around a first rotary shaft running in a left and right direction between an operation position in which the console box is disposed horizontally and a retracted position in which the console box is rotated rearward from the operation position; and a bellows having a lower end fixed on a floor side of the operator's seat, and an upper end rotatably linked to the console box in the forward and backward direction around a second rotary shaft running in the left and right direction.

2. The work vehicle according to claim 1, wherein the console box has a pair of linking components that are formed opposite each other in the left and right direction and that link to the upper end of the bellows, a pair of first through-holes that are opposite each other in the left and right direction are formed in the linking components, a pair of second through-holes that are opposite each other in the left and right direction are formed in the upper end of the bellows, a pin is inserted into the first through-hole and the second through-hole in each of the left and right linking components and the upper ends of the bellows.

3. The work vehicle according to claim 2, wherein the first through-holes and/or the second through-holes are slots, and the pins are inserted slidably in the slots.

4. The work vehicle according to claim 3, wherein the slots are formed in a linear shape, facing upward and obliquely rearward from below.

5. The work vehicle according to claim 1, further comprising a support component having the first rotary shaft and rotatably supporting the console box, the console box being configured to be capable of sliding in the forward and backward direction with respect to the support component.

6. The work vehicle according to claim 1, further comprising an operation lever provided to the console box;

a hydraulic actuator configured to change a steering angle according to supplied fluid;

a control valve disposed on a lower side of the floor of the operator's seat to control the fluid supplied to the hydraulic actuator; and a linking component linking the operation lever and the control valve, the bellows covering an area around the linking component.

7. The work vehicle according to claim 1, wherein the bellows includes a bellows main body formed from an elastic member and an upper frame, the bellows main body is attached to a lower portion of the upper frame, and the second rotary shaft is rotatably connected to the upper frame at a position above the lower portion where the bellows main body is attached.

8. A work vehicle comprising:

a console box disposed on a side of an operator's seat, the console box being rotatable in a first direction around a first rotary shaft running in a second direction between an operation position and a retracted position; and a bellows having a lower end fixed on a floor side of the operator's seat, and an upper end rotatably linked to the console box in the first direction around a second rotary shaft running in the second direction.

9. The work vehicle according to claim 8, wherein the bellows includes a bellows main body formed from an elastic member and an upper frame, the bellows main body is attached to a lower portion of the upper frame, and the second rotary shaft is rotatably connected to the upper frame at a position above the lower portion where the bellows main body is attached.

* * * * *